US009882260B2

(12) United States Patent
Mummert et al.

(10) Patent No.: US 9,882,260 B2
(45) Date of Patent: Jan. 30, 2018

(54) RETAINER SYSTEM FOR A MOBILE-TELEPHONY ANTENNA AND A MOBILE-TELEPHONY COMPONENT

(71) Applicant: KATHREIN-WERKE KG, Rosenheim (DE)

(72) Inventors: Wolfgang Mummert, Prutting (DE); Stefan Weber, Söchtenau (DE); Torsten Wulff, Vogtareuth (DE); Joachim Grimm, Flintsbach am Inn (DE)

(73) Assignee: Kathrein-Werke KG, Rosenheim (DE)

( * ) Notice: Subject to any disclaimer, the term of this patent is extended or adjusted under 35 U.S.C. 154(b) by 112 days.

(21) Appl. No.: 14/407,689

(22) PCT Filed: Jun. 13, 2013

(86) PCT No.: PCT/EP2013/001755

§ 371 (c)(1),
(2) Date: Dec. 12, 2014

(87) PCT Pub. No.: WO2013/185925

PCT Pub. Date: Dec. 19, 2013

(65) Prior Publication Data

US 2015/0115117 A1 Apr. 30, 2015

(30) Foreign Application Priority Data

Jun. 15, 2012 (DE) ..... 10 2012 011 892

(51) Int. Cl.
*H01Q 1/12* (2006.01)

(52) U.S. Cl.
CPC ..... *H01Q 1/1207* (2013.01); *H01Q 1/1228* (2013.01); *H01Q 1/1242* (2013.01)

(58) Field of Classification Search
USPC ..... 248/218.4, 219.2, 544, 222.52, 224.7, 248/227.2, 228.4, 230.4, 231.51, 316.5;
(Continued)

(56) References Cited

U.S. PATENT DOCUMENTS 3,561,712 A * 2/1971 Newsome ..... H02G 7/00 211/107
3,821,745 A * 6/1974 Bogner ..... H01Q 21/29 343/770

(Continued)

FOREIGN PATENT DOCUMENTS

CN 201247823 Y 5/2009
CN 201466222 U 5/2010

(Continued)

OTHER PUBLICATIONS

Search Report dated Dec. 30, 2015, issued in corresponding Chinese Patent Application No. 201380040241.2.

(Continued)

*Primary Examiner* — Terrell L McKinnon
*Assistant Examiner* — Michael McDuffie
(74) *Attorney, Agent, or Firm* — Nixon & Vanderhye P.C.

(57) ABSTRACT

The invention relates to an improved retainer system for a mobile-telephony antenna and a mobile-telephony component, which is characterized inter alia, by the following features: —said mobile-telephony component (MK) is secured, on the carrier side, by a retainer system which is separate from the retainer device (11, 7) for said mobile-telephony antenna (MA), —the retainer system also comprises at least one carrier-side mobile-telephony component-retainer device (17), —said mobile-telephony component (MK) comprises at least component-side mobile-telephony component-retainer device (25), —an interface and/or separating point (X) or a pivoting and/or displacement plane (E)

(Continued)

Figure 1A:
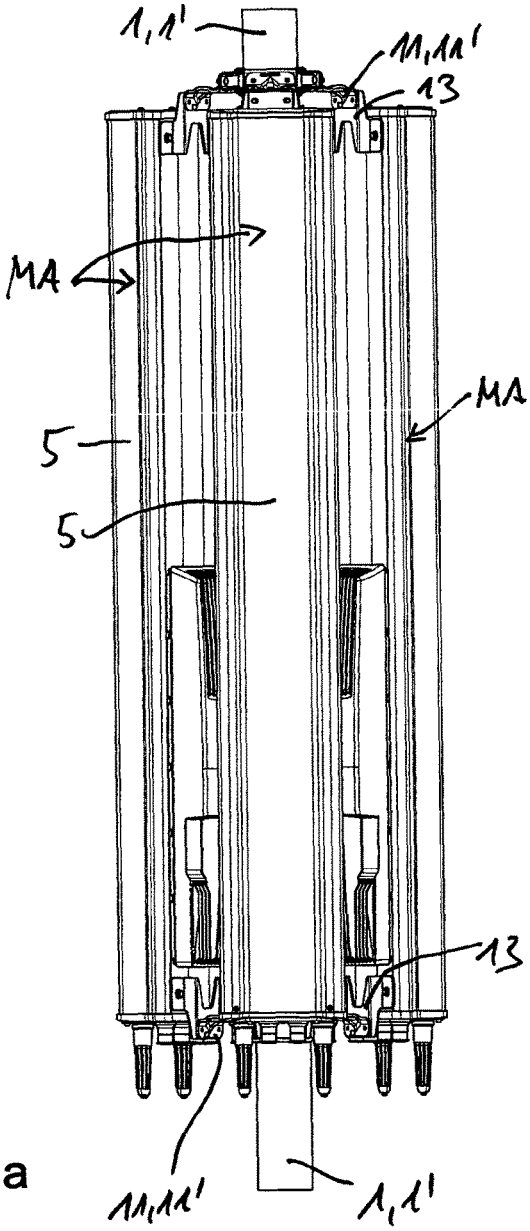

is formed between said carrier-side mobile-telephony component-retainer device (17) and the respective component-side mobile-telephony component-retainer device (25), and —when the associated fixture means are released, the mounted mobile-telephony component (MK) may be removed, with the component-side mobile-telephony component-retainer device (25), in a lateral direction (SR) out of the spacing (A) by means of displacement and/or pivoting and/or rotation, leaving behind the carrier-side mobile-telephony component-retainer device (17) even with said mobile-telephony antenna (MA) remaining mounted.

14 Claims, 33 Drawing Sheets

(58) Field of Classification Search
USPC ..... 343/878, 890, 891, 892; 52/40
See application file for complete search history.

(56) References Cited

U.S. PATENT DOCUMENTS

| | | | | |
|---|---|---|---|---|
| 3,829,864 | A * | 8/1974 | Truskanov | H01Q 21/00 343/833 |
| 4,223,315 | A * | 9/1980 | Alford | H01Q 1/36 343/742 |
| 5,707,033 | A | 1/1998 | Holt et al. | |
| 6,222,504 | B1 * | 4/2001 | Oby | H01Q 1/1228 343/890 |
| 6,268,828 | B1 * | 7/2001 | Martek | H01Q 3/242 342/373 |
| 6,283,425 | B1 * | 9/2001 | Liljevik | F16M 13/02 248/218.4 |
| 6,456,258 | B1 * | 9/2002 | Bragg | H01Q 1/088 343/757 |
| 6,739,561 | B2 * | 5/2004 | Herzog | H01Q 1/1221 248/218.4 |
| 6,969,034 | B2 | 11/2005 | Ware et al. | |
| 7,084,834 | B1 * | 8/2006 | Hopkins | H01Q 1/246 343/878 |
| 7,106,273 | B1 * | 9/2006 | Brunson | H01Q 1/246 343/878 |
| 7,253,786 | B1 * | 8/2007 | Logozzo | E04H 12/08 343/890 |
| 8,794,578 | B2 * | 8/2014 | Lin | H01Q 1/1228 248/218.4 |
| 9,252,479 | B2 * | 2/2016 | Kolokotronis | H01Q 1/1242 |
| 2002/0084949 | A1 * | 7/2002 | Skalina | H01Q 9/16 343/891 |
| 2004/0027307 | A1 * | 2/2004 | Hossein | H01Q 1/1242 343/890 |
| 2004/0066353 | A1 * | 4/2004 | Ernest Ehlen | H01Q 1/1242 343/891 |
| 2004/0174317 | A1 * | 9/2004 | Dearnley | H01Q 1/1207 343/890 |
| 2004/0189540 | A1 * | 9/2004 | Schadler | H01Q 1/1242 343/890 |
| 2008/0011919 | A1 | 1/2008 | Wen et al. | |
| 2011/0233373 | A1 | 9/2011 | Ao et al. | |
| 2012/0038490 | A1 * | 2/2012 | Verfuerth | H05B 37/0272 340/910 |
| 2012/0211627 | A1 * | 8/2012 | Lee | H01Q 1/1228 248/316.5 |
| 2012/0228461 | A1 * | 9/2012 | Angseryd | H01Q 1/1242 248/513 |
| 2013/0201076 | A1 * | 8/2013 | Vos | H01Q 21/061 343/879 |

FOREIGN PATENT DOCUMENTS

| | | |
|---|---|---|
| CN | 201528038 U | 7/2010 |
| CN | 201682050 U | 12/2010 |
| CN | 102044736 A | 5/2011 |
| DE | 299 12 906 | 12/1999 |
| DE | 202 15 290 | 4/2003 |
| EP | 2 124 290 | 11/2009 |
| EP | 2 343 777 | 7/2011 |
| WO | 2011/050531 A1 | 5/2011 |
| WO | WO 2012/094890 | 8/2011 |

OTHER PUBLICATIONS

English translation of the International Preliminary Report on Patentability and the Written Opinion of the International Searching Authority dated Dec. 24, 2014, issued in corresponding International Application No. PCT/EP2013/001755.
International Search Report for PCT/EP2013/001755 dated Sep. 9, 2013.
Written Opinion of the International Searching Authority (foreign language), for PCT/EP2013/001755 dated Sep. 9, 2013.
"Modified Product Line of Mounting Parts", Kathrein Antennen Electronic, Apr. 4, 2011, 1 page.
RRU3804 Introduction and Hardware Installation, HUAWEI, pdf-Datum, Jun. 4, 2008, 30 pages.

* cited by examiner

RETAINER SYSTEM FOR A MOBILE-TELEPHONY ANTENNA AND A MOBILE-TELEPHONY COMPONENT

This application is the U.S. national phase of International Application No. PCT/EP2013/001755 filed 13 Jun. 2013 which designated the U.S. and claims priority to DE 10 2012 011 892.9 filed 15 Jun. 2012, the entire contents of each of which are hereby incorporated by reference.

The invention relates to a retainer system for a mobile-telephony antenna and an associated mobile-telephony component, for example in the form of a remote radio head in accordance with the preamble of claim 1.

In the meantime, mobile-telephony antennas have become widespread. They generally comprise antenna arrangements, which radiate for example only in one sector or in a plurality of sectors, for example in three sectors. In a three-sector antenna, the individual radiators, generally arranged vertically above one another, are each fixed to the mast carrying them offset about said mast in a 120° direction.

The individual antennas usually comprise a number of radiators arranged above one another, which radiate for example in one polarisation or preferably in two mutually perpendicular polarisation planes. Often, these two polarisation planes are arranged at a +45° and −45° angle to the horizontal or vertical. In this context, it is common to refer to an X polarisation.

They may further be mono-band, dual-band or multi-band antennas which transmit and/or receive in a plurality of frequency bands.

Finally, it should also further be noted that as well as the single-gap antenna arrays, two-gap or multi-gap antenna arrays are often also used, meaning that the antenna arrangement as a whole can generally be not only of a different height (depending on the desired antenna gain) but also relatively wide.

In accordance with the current standard, the mobile-telephony stations are increasingly being equipped with further mobile-telephony components, in other words components such as a remote radio head. This can be provided set apart from the actual antenna in the region of the mobile-telephony station. Often, in the case of an antenna mounted on a mast, it is likewise fixed to the mast itself, usually below the actual antenna arrangement.

A retaining system for a mobile-telephony antenna and associated mobile-telephony components is further known from EP 2 124 290 A1. For example, an antenna arrangement is shown which is mounted on a mast.

Each of these individual sector antennas is fixed to the mast via an upper and a lower antenna holding device. The holding devices may be made clip-shaped.

Further, according to this prior publication, a support plate extending vertically or predominantly vertically is provided, and can also be mounted on the antenna mast in an angular orientation (by setting a mechanically adjustable downtilt angle). This mounting is carried out using a V-shaped spacer, positioned above, which comprises two spacer arms, which extend about a horizontal axis and can be pivoted towards or away from one another in a V shape. There is a fixing portion at each of the opposite free ends of the spacer, one fixing portion being fixed to the mast at the support-side holding device and the opposite, antenna-side fixing portion being fixed to the support plate.

The respectively lower support-side holding device is directly articulated to an antenna-side holding device, in other words without a spacer being interposed.

In this prior publication, it is found to be an advantage that an electronic component, such as a remote radio head (RRH), can be mounted on the rear face, facing the mast, of a respective support plate, the corresponding antenna in this case being mounted on the front face, facing away from the mast, of the support plate. The corresponding electronic components can be removed or introduced parallel to the support plate or supplied upwards from below parallel to the support plate plane in the mounting direction and mounted or dismounted and withdrawn in the opposite direction.

FIG. 1 and FIG. 7 of EP 2 343 777 A1 show a further embodiment. Whereas in the aforementioned prior art of EP 2 124 290 A1 the mobile-telephony component is mounted directly on the rear face and held and braced on a mast together with the mobile-telephony antenna via the upper and lower support device, the solution according to EP 2 343 777 A1 is that the mobile-telephony component is held on the rear face of the mobile-telephony antenna via a support device, which is braced on the upper and lower holding device of the mobile-telephony antenna, via which the mobile-telephony antenna is held on an antenna mast.

Fixing devices of the type usually used in mounting an antenna are known for example from the prior publication "Modified Product Line of Mounting Parts, Kathrein, 4.1.201, 14 Dec. 2012". These are conventional fixing devices.

From a further prior publication, namely RRU3804 Introduction and Hardware Installation, HUAWEI, PDF date 6 Apr. 2008, posted on the Internet as of 17 Dec. 2012, it can be seen that various examples of mobile-telephony components and the manner of mounting are disclosed.

For example, page 9 shows how one or more mobile-telephony components can be mounted on an antenna mast if no antenna and in particular no mobile-telephony antenna is provided in this region.

Similarly configured fixing devices for separate mobile-telephony components or other mountable components and housings on an antenna mast are known for example from WO 2012/094 890 A1. However, merely the fixing of housings and components to a mast is disclosed. Where and how mobile-telephony antennas are fixed cannot be seen from this prior publication.

The use of mast clips having a latching function for rapid fixing by a single person, in various configurations, is known for example from US 2011/0 233 373 A1.

U.S. Pat. No. 5,707,033 A merely discloses a suspension variant of a satellite antenna on the wall of a mobile home.

Finally, reference should further be made to U.S. Pat. No. 6,969,034B2, which likewise merely discloses a suspension system for mounting a box-like housing to a mast using straps.

The object of the present invention is to provide a relatively improved solution for a retaining system for a mobile-telephony antenna and an associated mobile-telephony component on a support, in particular on a mast-shaped or wall-shaped support.

The object is achieved according to the invention by the features given in claim 1. Advantageous configurations of the invention are given in the dependent claims.

By way of the present invention, using comparatively simple means, a highly favourable possibility is provided for mounting not only a mobile-telephony antenna but an associated electronic component, in other words a mobile-telephony component such as a remote radio head, to a mast or for example to a wall of a building.

For this purpose, the invention provides that the corresponding antenna arrangement can be mounted on the mast-shaped or wall-shaped support using a spacer device in such a way that a separating space, in which the mobile-telephony component can likewise be mounted, is produced between the rear face of the antenna (generally on the rear face of the reflector and/or of the radome) and the mast-side or wall-side support. According to the invention, however, the mobile-telephony component is mounted completely separately from the mobile-telephony antenna and the wire construction thereof, in other words independently using its own fixing means on the mast-shaped or wall-shaped support.

This ultimately means that it is possible to omit a shared support plate (comparable to the formation of the generic prior art of EP 2 124 290 A1). Further, the separate holding and support device for the mobile-telephony component and the mobile-telephony antenna device ensures that the actual holding and fixing devices each have to receive much smaller weights, and thus the pressure and force conditions due to wind load cannot so easily lead to damage, whilst the individual weights to be supported by way of the holding device are configured to be smaller.

In the context of the invention, it is possible to fix the corresponding mobile-telephony component and above all the optional plurality of mobile-telephony components, (for example a mobile-telephony antenna radiating in two or three sectors), to a mast in a particularly simple manner. This is because, in this case, in the context of the invention it is possible to use a shared upper and lower holding device, which can be fixed to the mast and which can hold two or for example three mobile-telephony components, positioned mutually offset at equal angular intervals, in each case in the peripheral direction of the mast.

In some cases, pre-mounting may take place, in such a way that at the preferably clip-shaped holding devices on the mast, not only one but even two or possibly three mobile-telephony components, positioned offset in the peripheral direction, are pre-mounted and fixed jointly to the mast. Otherwise, optionally at least one of these mobile-telephony components may be attached to the mast by way of the corresponding fixing device and the other mobile-telephony components may be mounted subsequently, indeed without any obstacle whatsoever, since each mobile-telephony component is freely accessible from the outside in a plan view of the support, generally the mast-shaped support.

In a second step, the fixing device comprising the antennas can be positioned mounted above this.

Once mounting is complete, in the context of the invention also individual mobile-telephony components may nevertheless, if required, be dismounted in the free space between the antenna and the mast-shaped or wall-shaped support.

For this purpose, the invention provides that the holding device of the mobile-telephony components comprises an additional interface and/or partition comprising a component side sub-unit and a support side sub-unit in each case. In other words, a mobile-telephony component along with the component-side sub-unit carrying it can be released from the rest and subsequently removed for example by parallel displacement and/or pivoting preferably parallel to the vertical mast orientation or parallel to a wall-shaped support (preferably a building wall), so as subsequently to lower this unit to the ground for example with the assistance of a traction cable device. Conversely, a corresponding mobile-telephony component can similarly be retrofitted for example after replacing a defective mobile-telephony component, by initially placing it on the corresponding interface and/or partition and thereby making it available, so as subsequently to apply it rigidly and securely to said interface and/or partition by tightening the fixing means.

In summary, it can thus be established that the retaining system according to the invention is suitable both for individual arrangements and for three-sector arrangements of mobile-telephony antennas when attaching a mobile-telephony component, for example in the form of a remote radio head, to the mast at a small distance behind the respective antenna. The retaining system according to the invention is not configured for a specific antenna and can be used with a number of antennas. The retainer is configured in such a way that in the case of a defect, replacement can be possible without moving or even dismounting the previously mounted antennas. In the context of the invention, this is achieved by way of additionally provided interfaces and/or partitions between a remote radio head of this type and associated parts of the fixing device and the fixing device which remains on the antenna mast.

A first sub-unit assigned to the mast and the further, second sub-unit assigned to the remote radio head are matched to and releasably fixed to one another. Once the fixing is released, the components to be replaced can not only be pulled out laterally behind the antenna but optionally also folded out or twisted out or be extracted from a combination of movement processes.

The solution according to the invention can be used not only for mounting on a mast but also for example for mounting on a building wall.

Figure 1B:
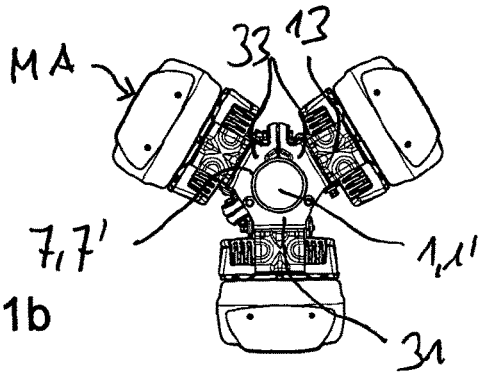

Further advantages, details and features can be found in the following from embodiments illustrated by way of drawings, in which, specifically:

FIG. 1*a* is a side view of a mobile-telephony antenna comprising a plurality of sector antennas and associated mobile-telephony components, mounted on a mast;

FIG. 1*b* is an axial plan view of the embodiment of FIG. 1*a;*

Figure 2B:
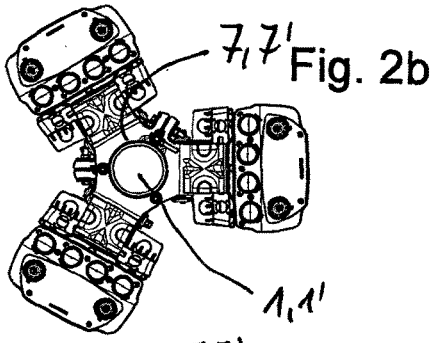
Figure 2A:
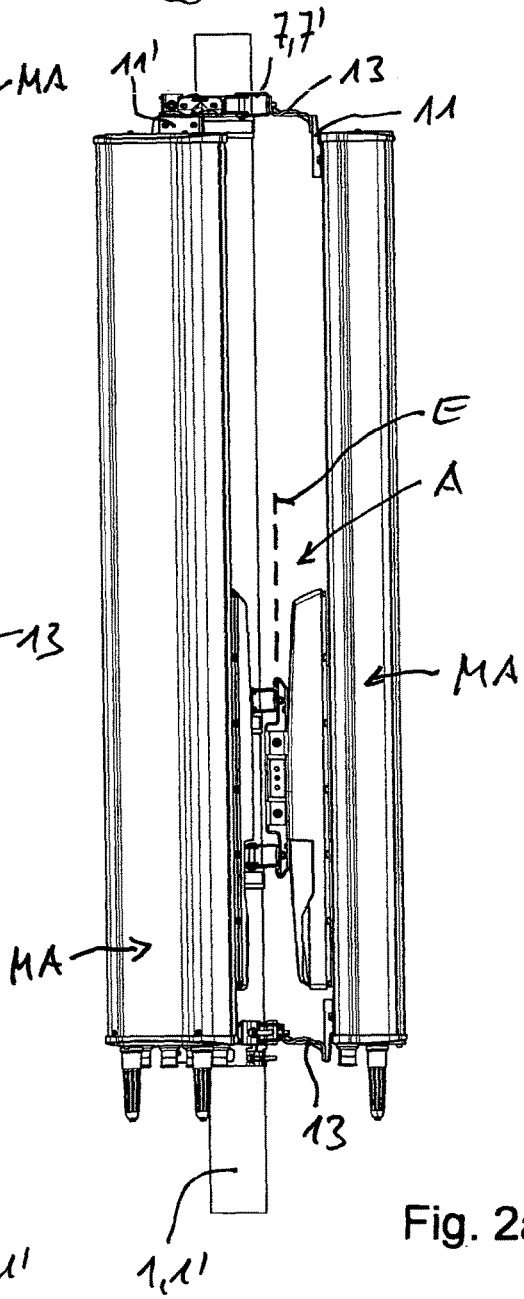

FIG. 2*a* is a side view corresponding to FIG. 1*a*, but in a side view rotated 30° about the mast;

FIG. 2*b* is an axial view from below of the embodiment of FIG. 2*a;*

Figure 3A:
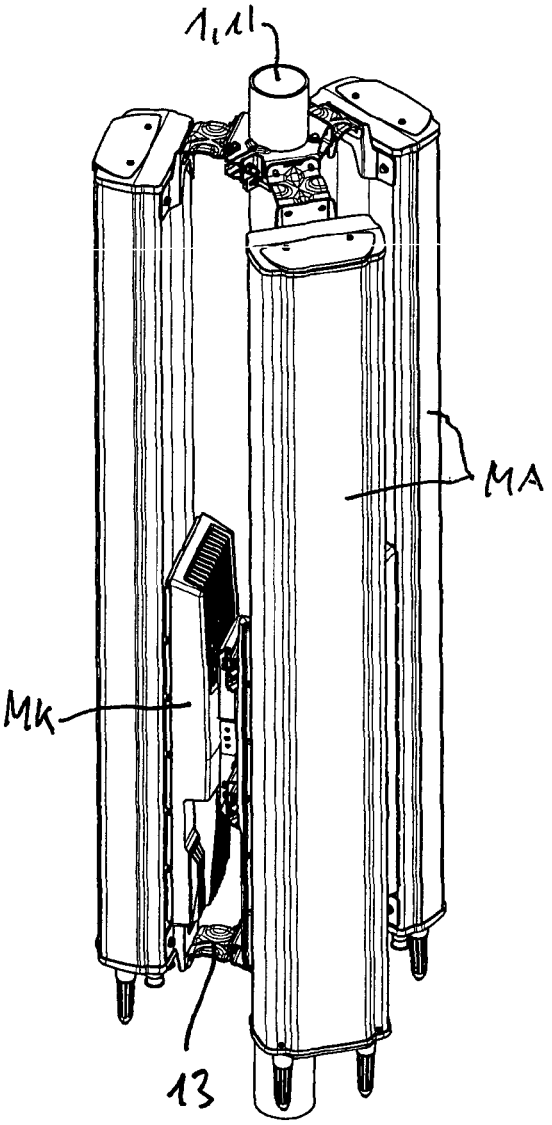

FIG. 3*a* is perspective view, from slightly above, of the embodiment of FIG. 1*a* to 2*b;*

Figure 3B:
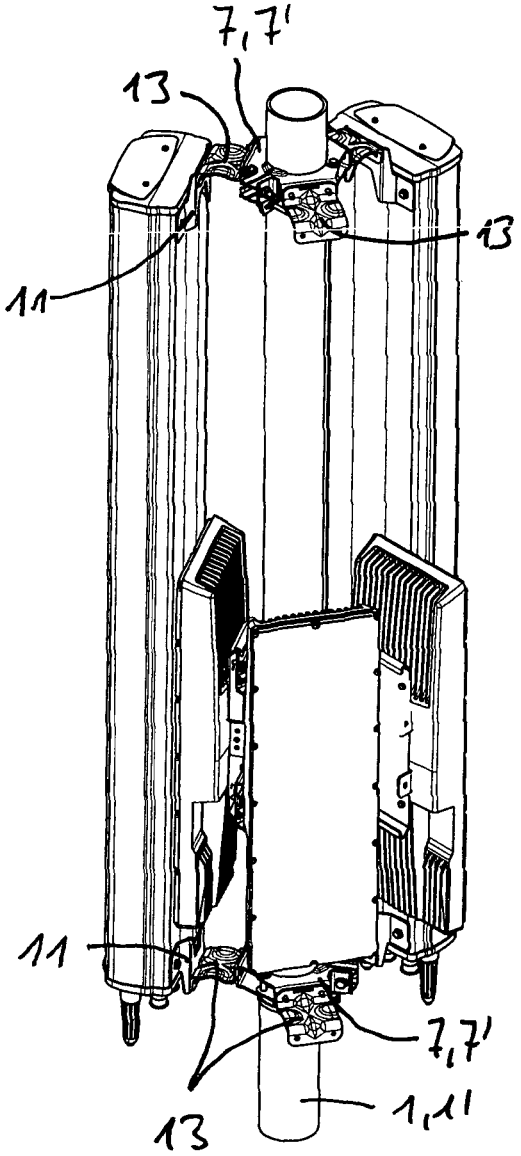
Figure 3C:
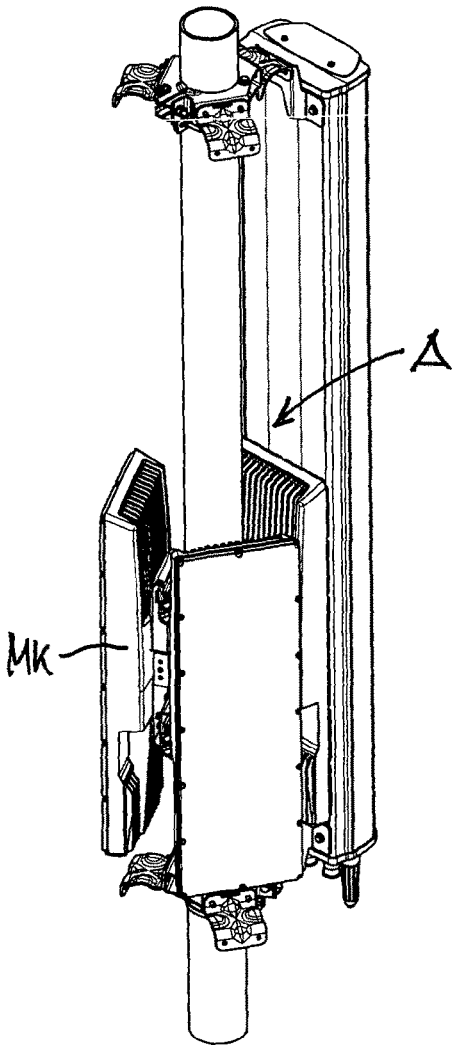
Figure 3D:
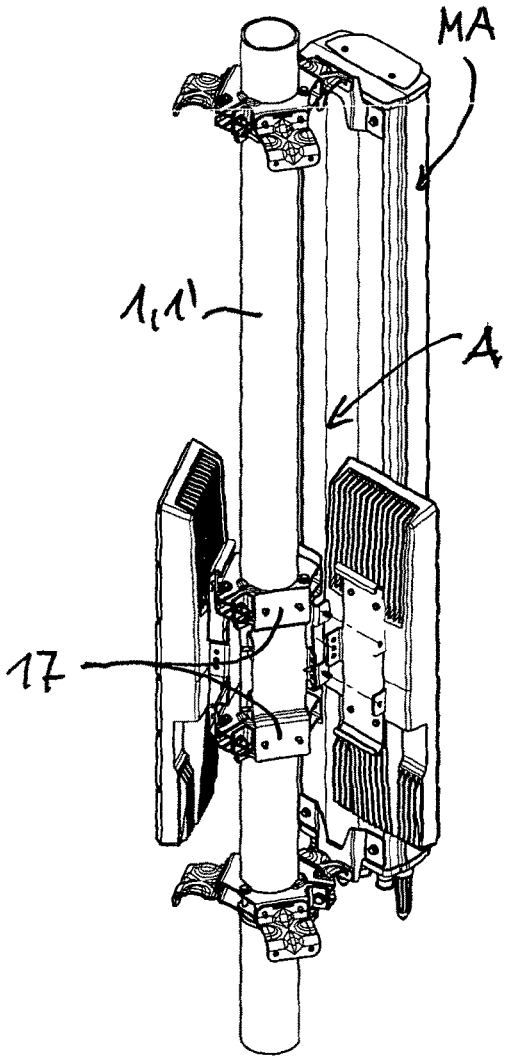
Figure 4B:
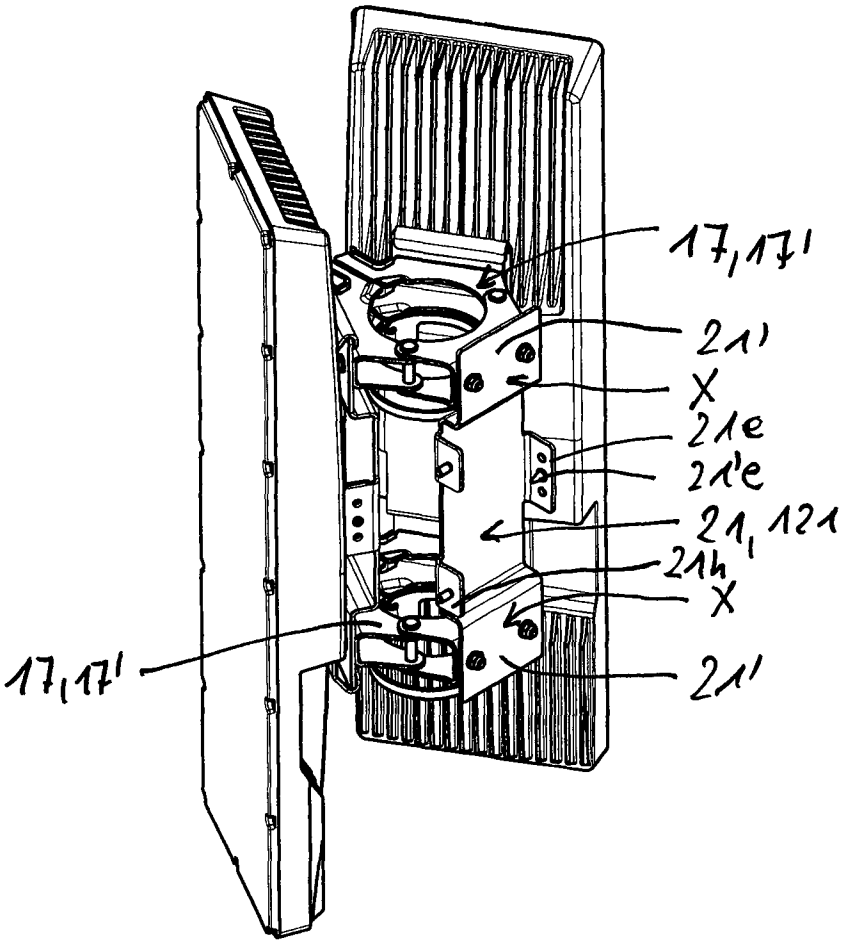
Figure 4A:
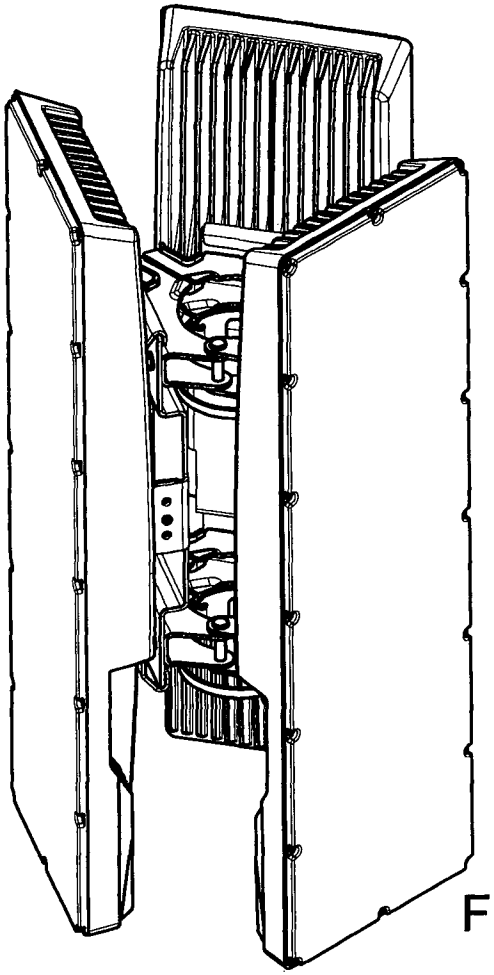
Figure 4C:
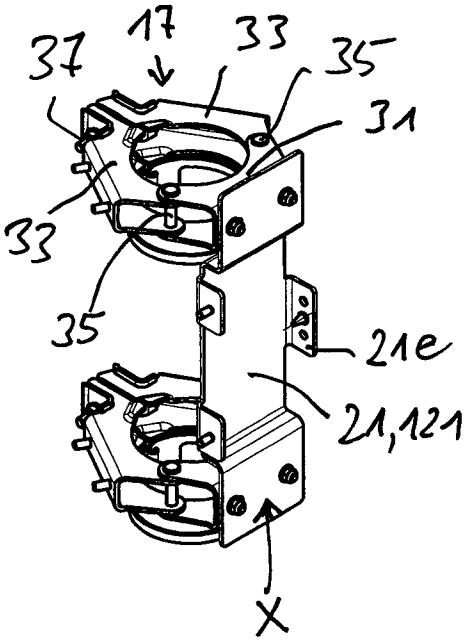
Figure 4D:
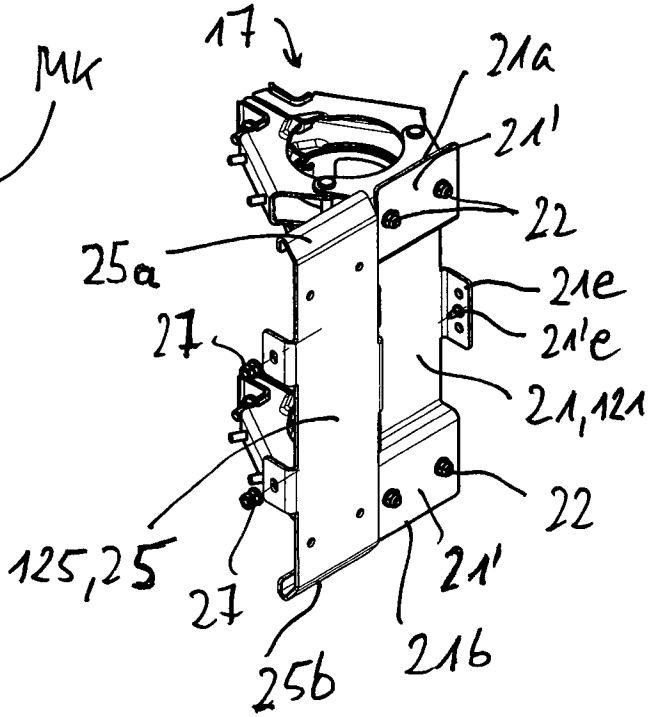
Figure 4E:
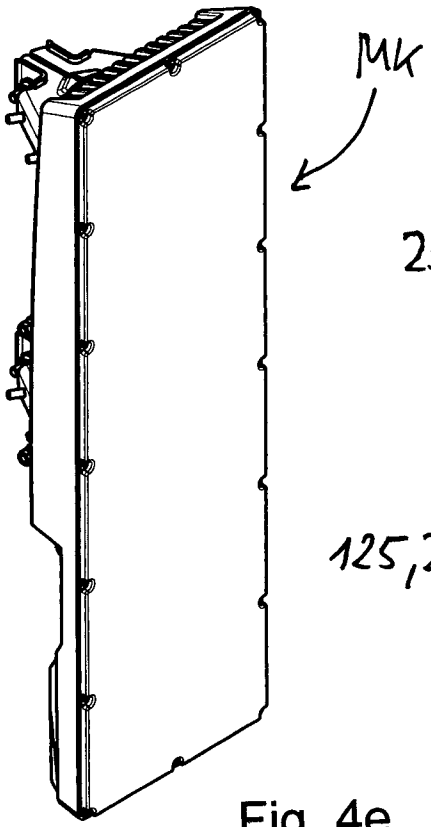
Figure 5A:
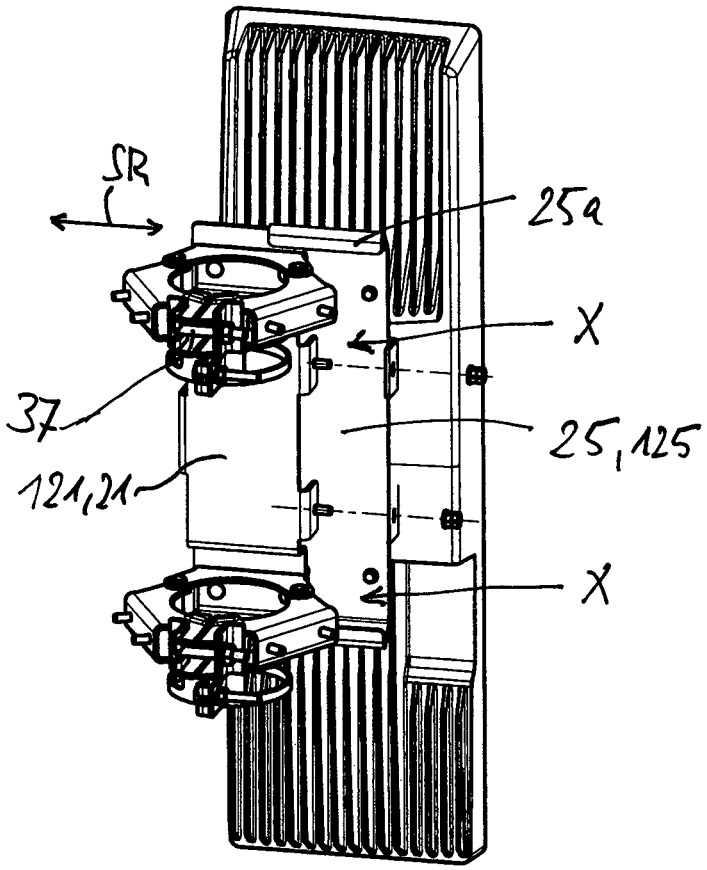
Figure 5B:
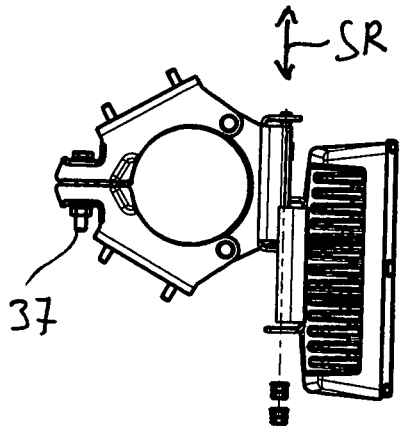

FIG. 3*b* is a drawing corresponding to FIG. 3*a*, but with the front sector antenna omitted, only the rear sector antenna being shown;

FIG. 3*c* is a drawing corresponding to FIG. 3*b*, but with the left and front mobile-telephony antennas omitted, the mobile-telephony components respectively located behind them being shown;

FIG. 3*d* is a drawing corresponding to FIG. 3*c*, but with the front mobile-telephony component additionally omitted (after the mobile-telephony component on an interface and/or partition has been disassembled or removed);

FIG. 4*a* is a three-dimensional drawing of three mobile-telephony components mutually offset by 120°, which are all pre-mounted on two mutually axially offset clip-shaped holding devices which can be fixed to a mast;

FIG. 4*b* is a drawing corresponding to FIG. 4*a*, but with the mobile-telephony component positioned on the right in FIG. 4*a* and the associated rearward connection piece omitted;

FIG. 4*c* shows a support-side holding device in a plate shape along with the two associated clip-shaped holding devices which can be fixed to a mast;

FIG. 4*d* is a drawing corresponding to FIG. 4*c*, but showing a second connection support, which is to be slid on at the side and to which the mobile-telephony component (not shown in FIG. 4*d*) is fixed;

FIG. 4*e* is a drawing corresponding to FIG. 4*d*, but showing the mobile-telephony component connected to the connection support;

FIG. 5*a* is a rear view of the mobile-telephony component with the associated rearward connection support, which is initially slid on in part on a support-side or mast-side connection support, which can be anchored to a mast support (not shown) by means of mast clips;

FIG. 5*b* is an axial plan view of the embodiment of FIG. 5*a;*

Figure 6A:
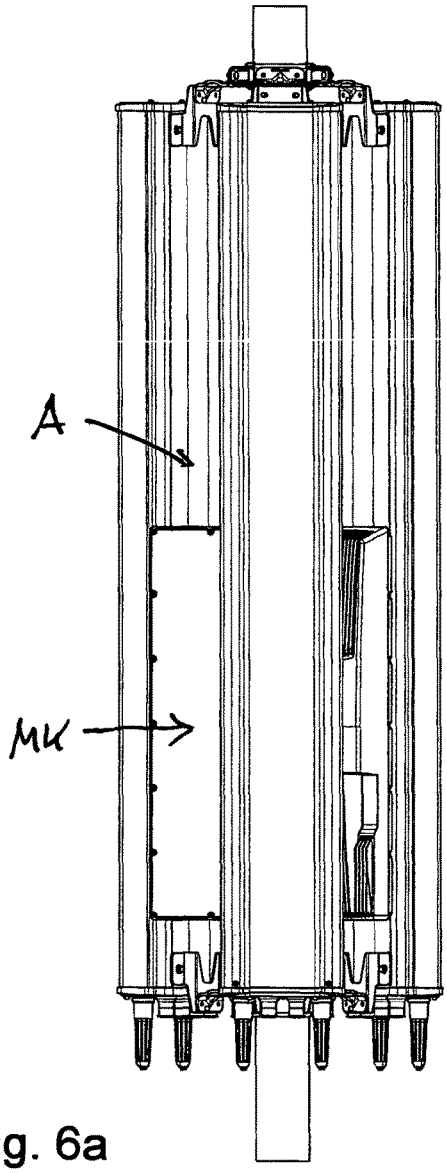
Figure 6B:
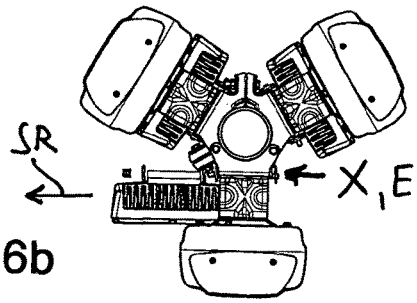
Figure 7B:
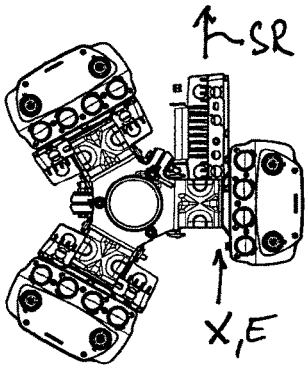
Figure 7A:
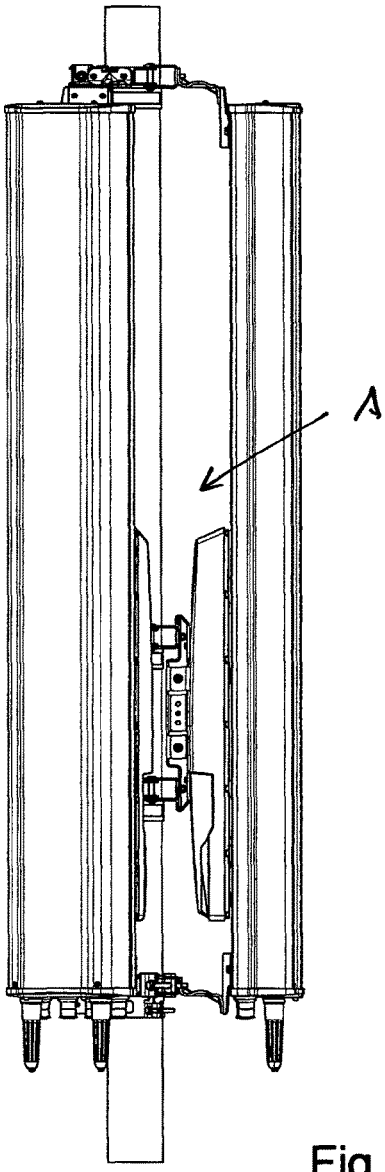
Figure 8C:
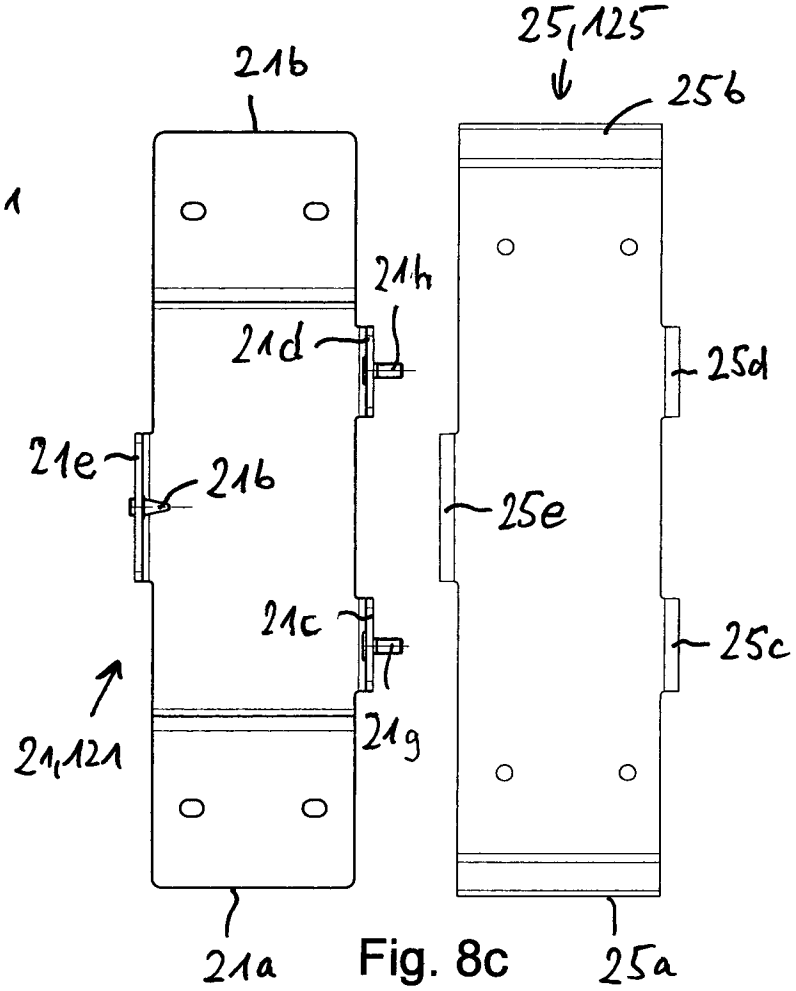
Figure 8A:
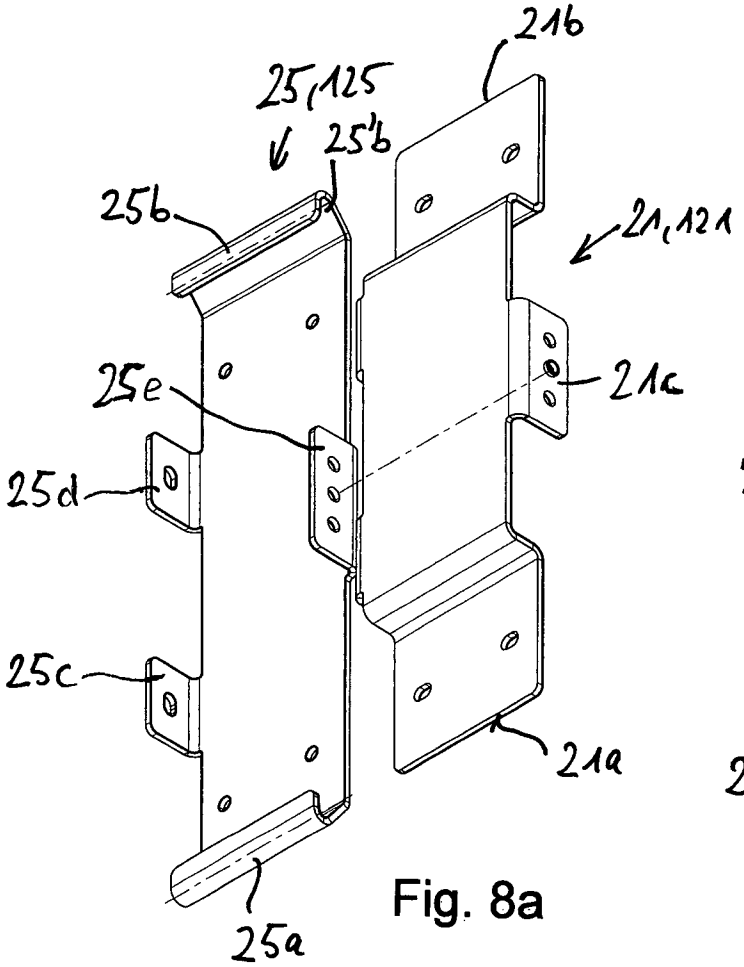
Figure 8B:
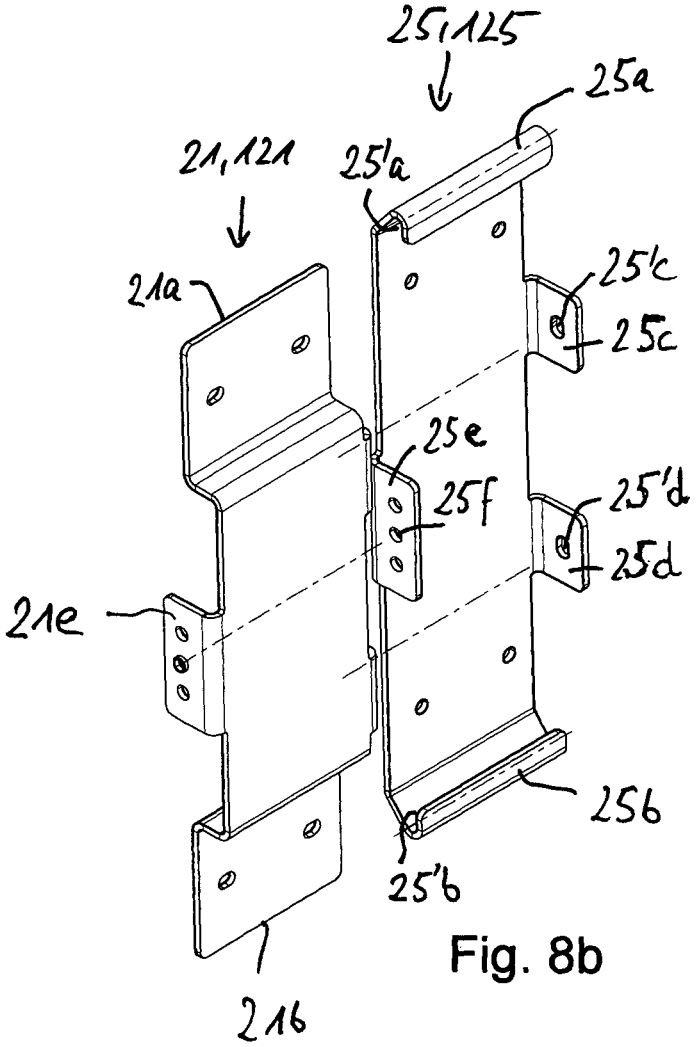
Figure 8D:
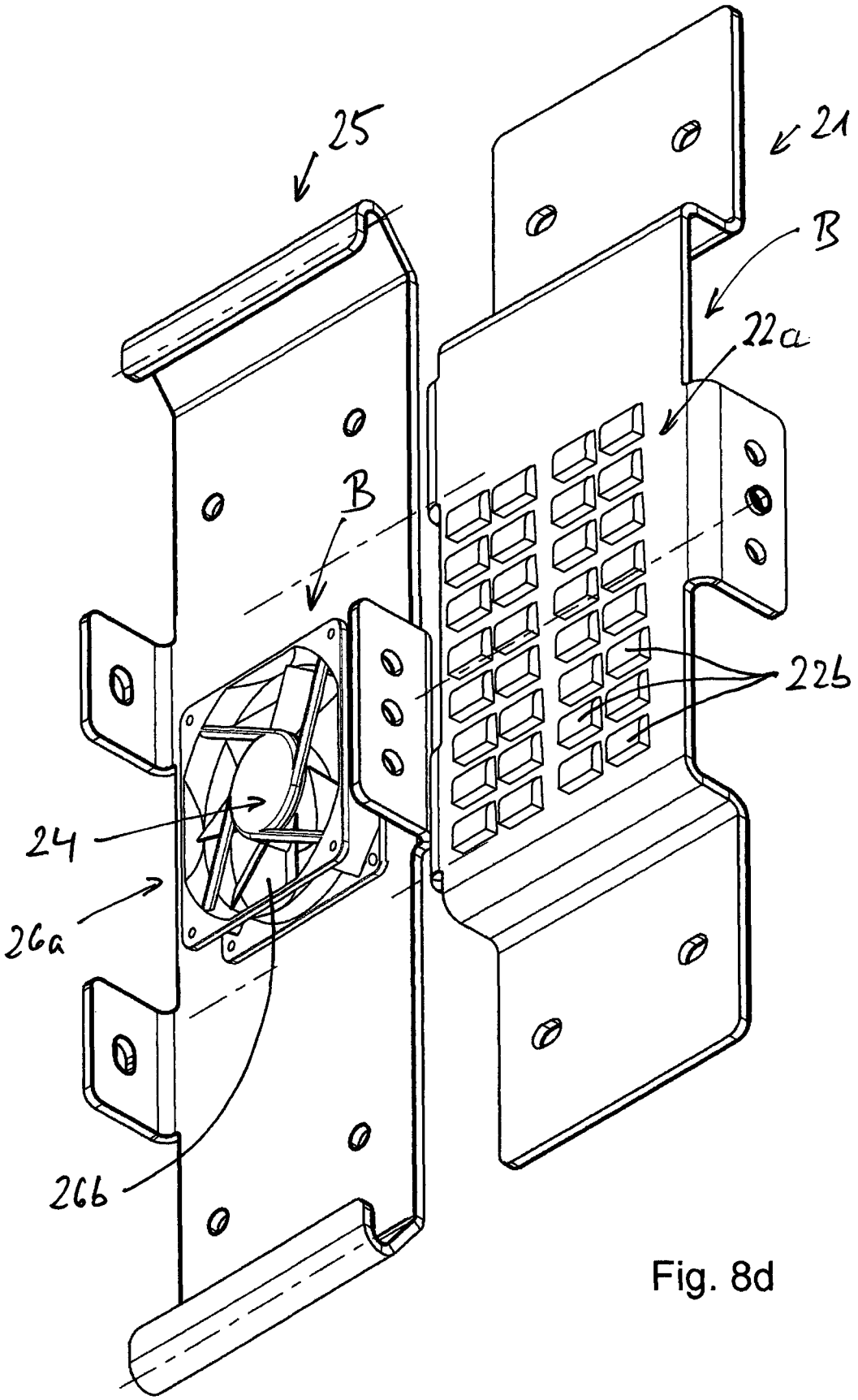
Figure 8E:
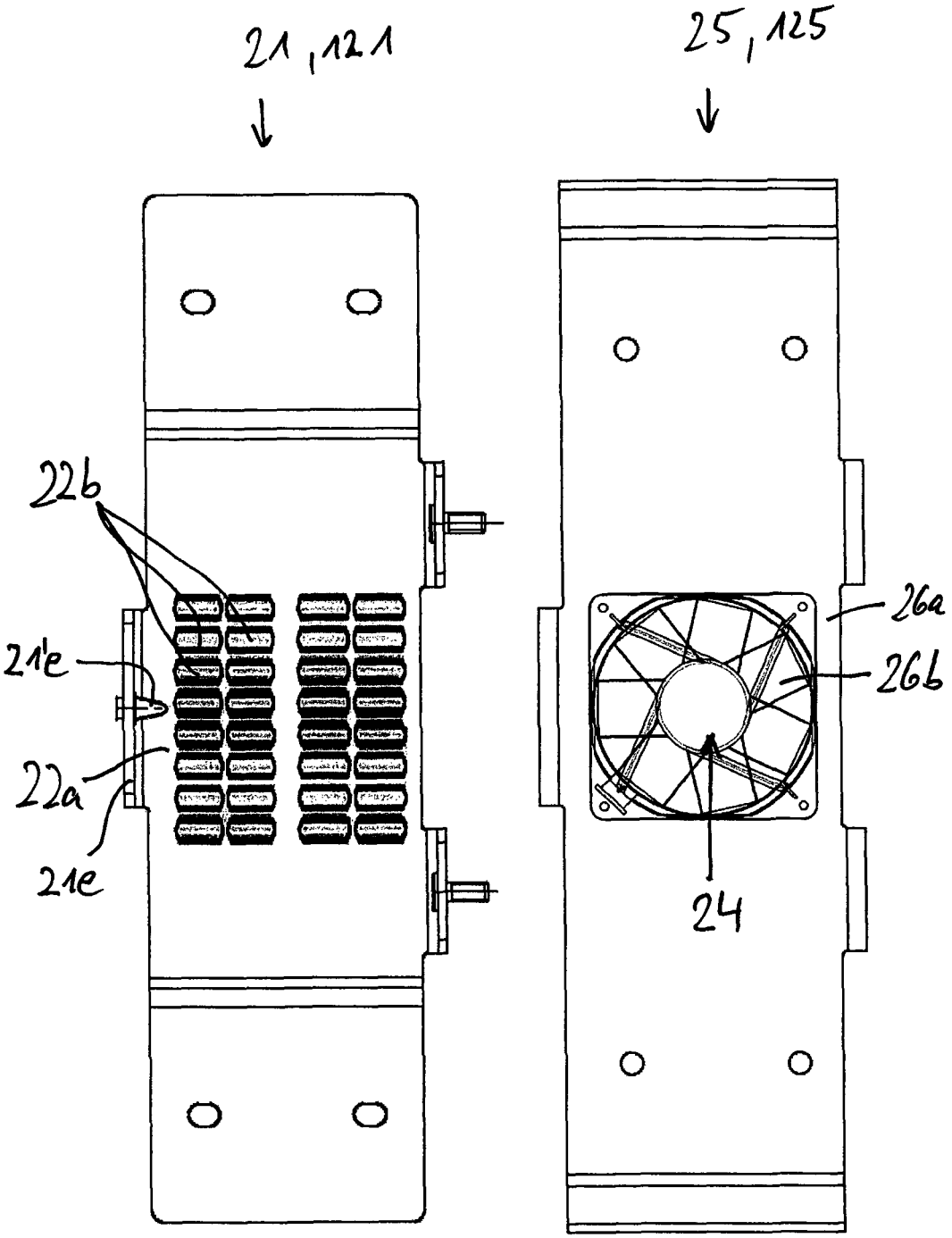
Figure 9A:
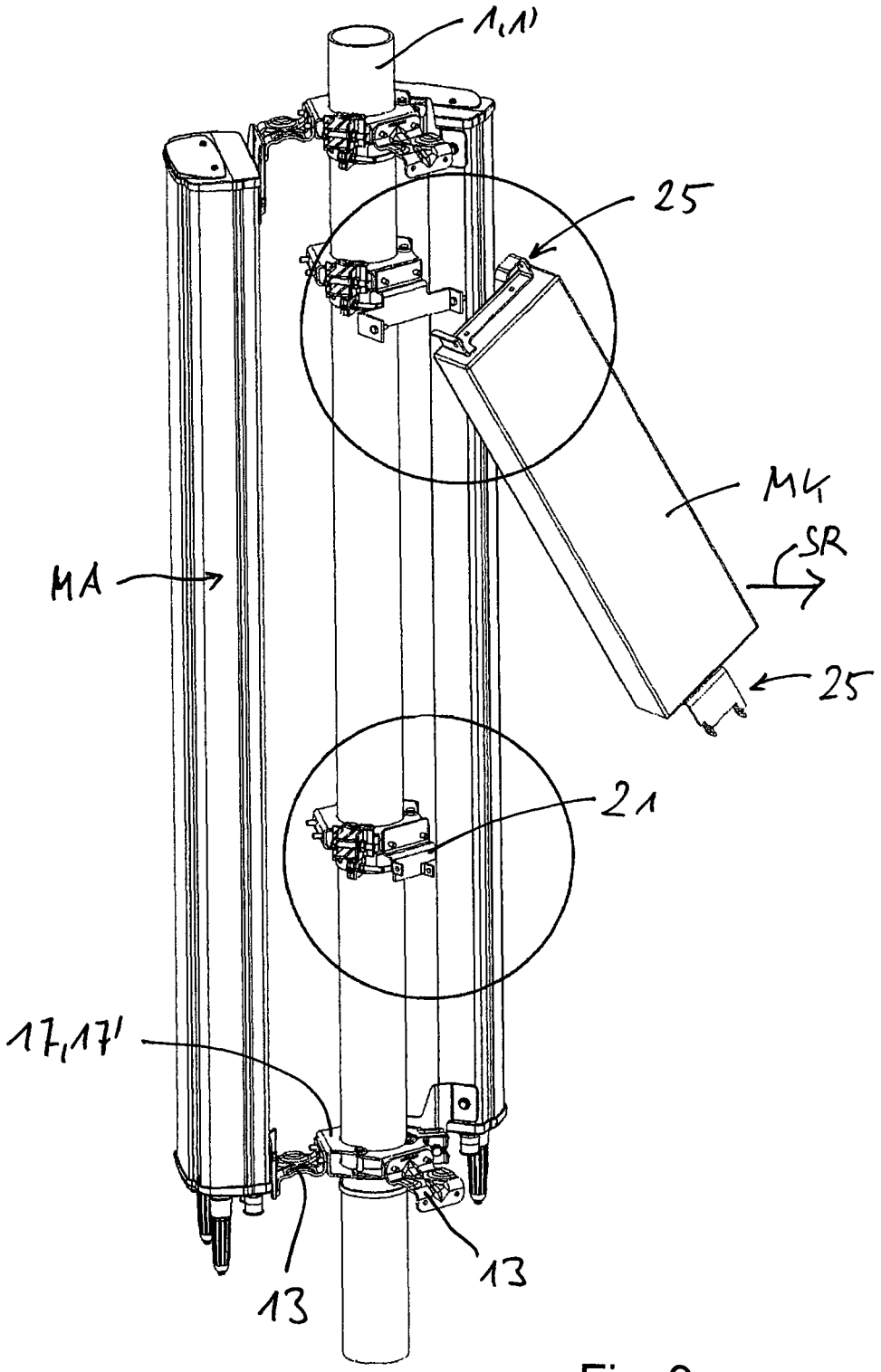
Figure 9B:
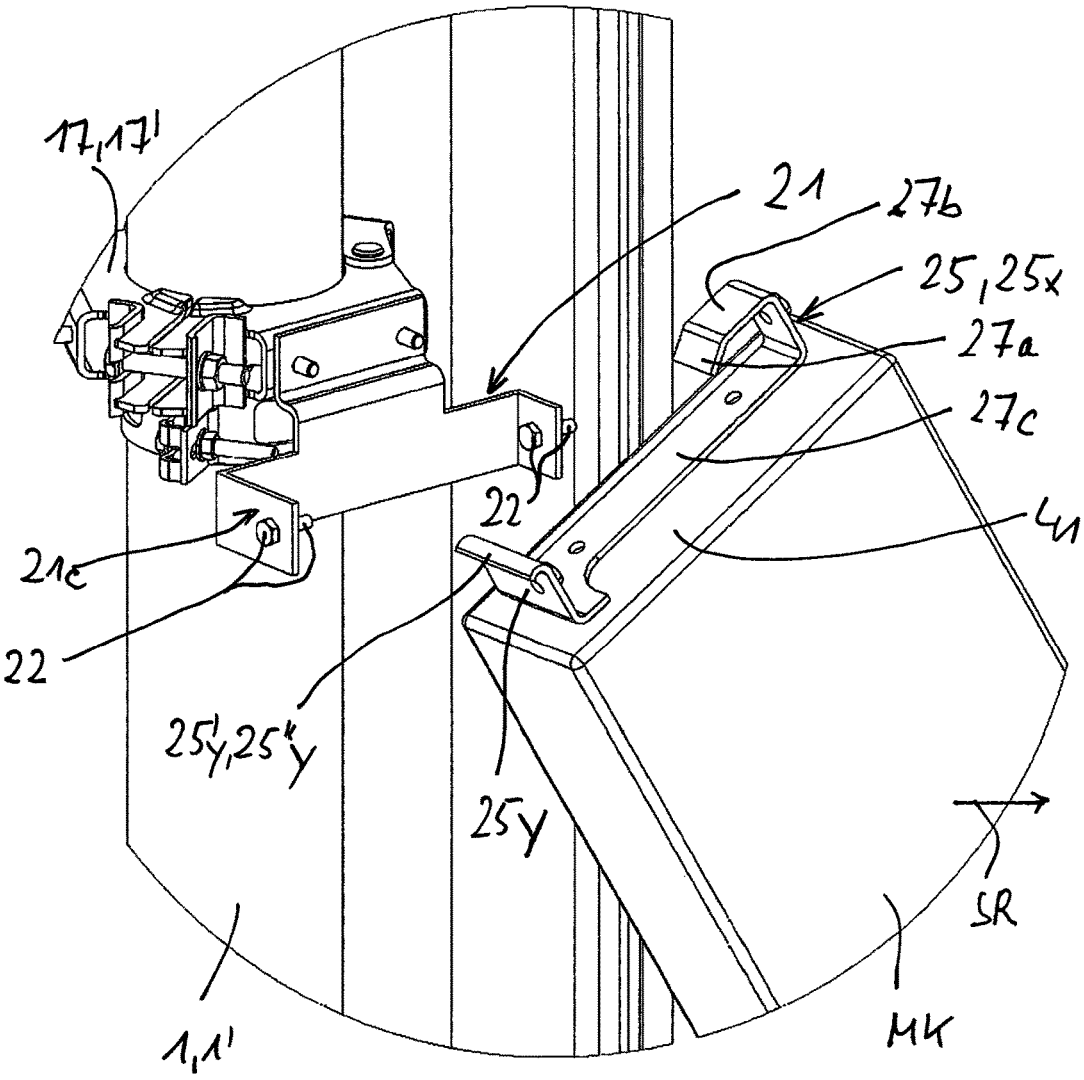
Figure 9C:
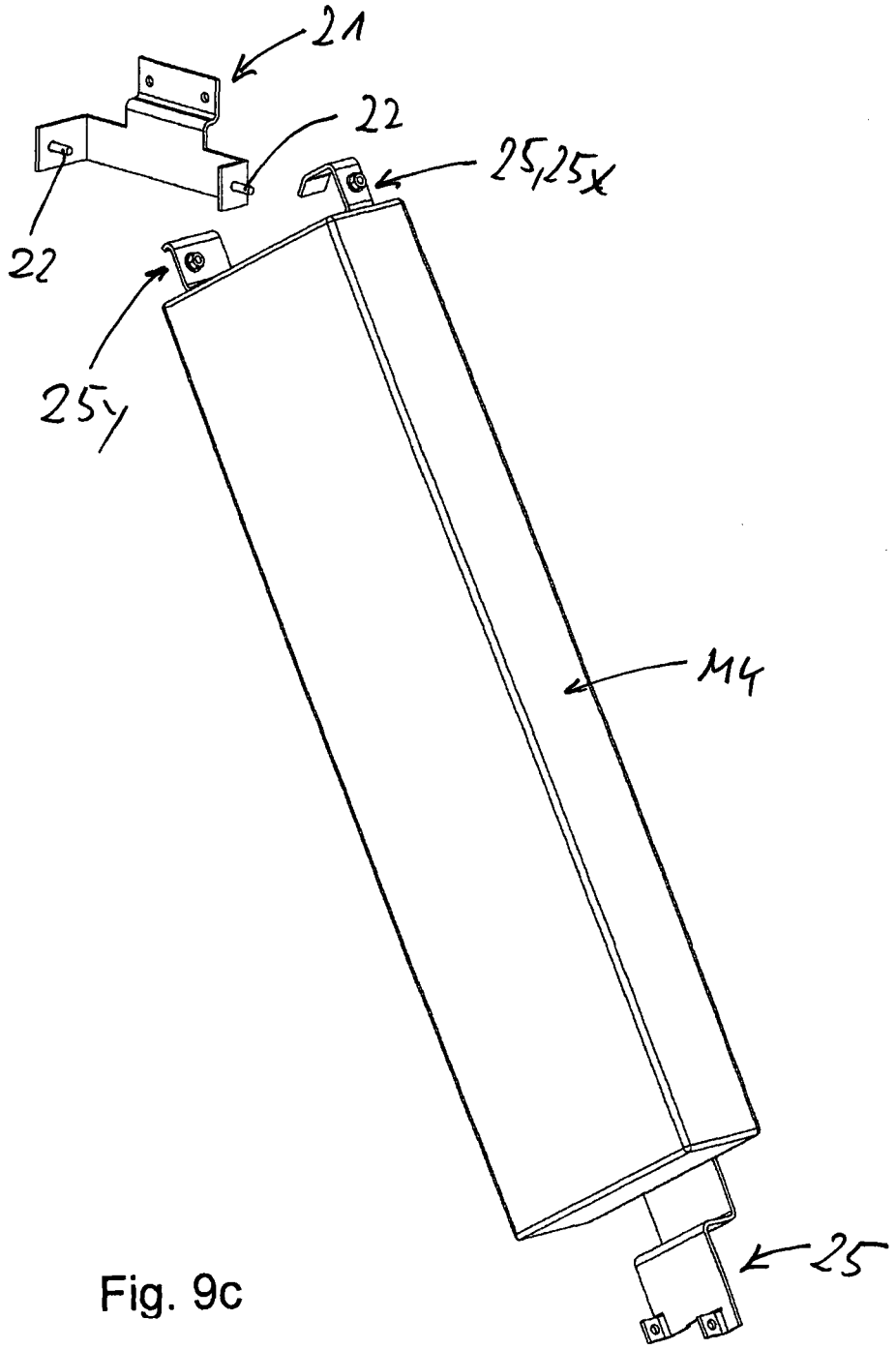
Figure 10A:
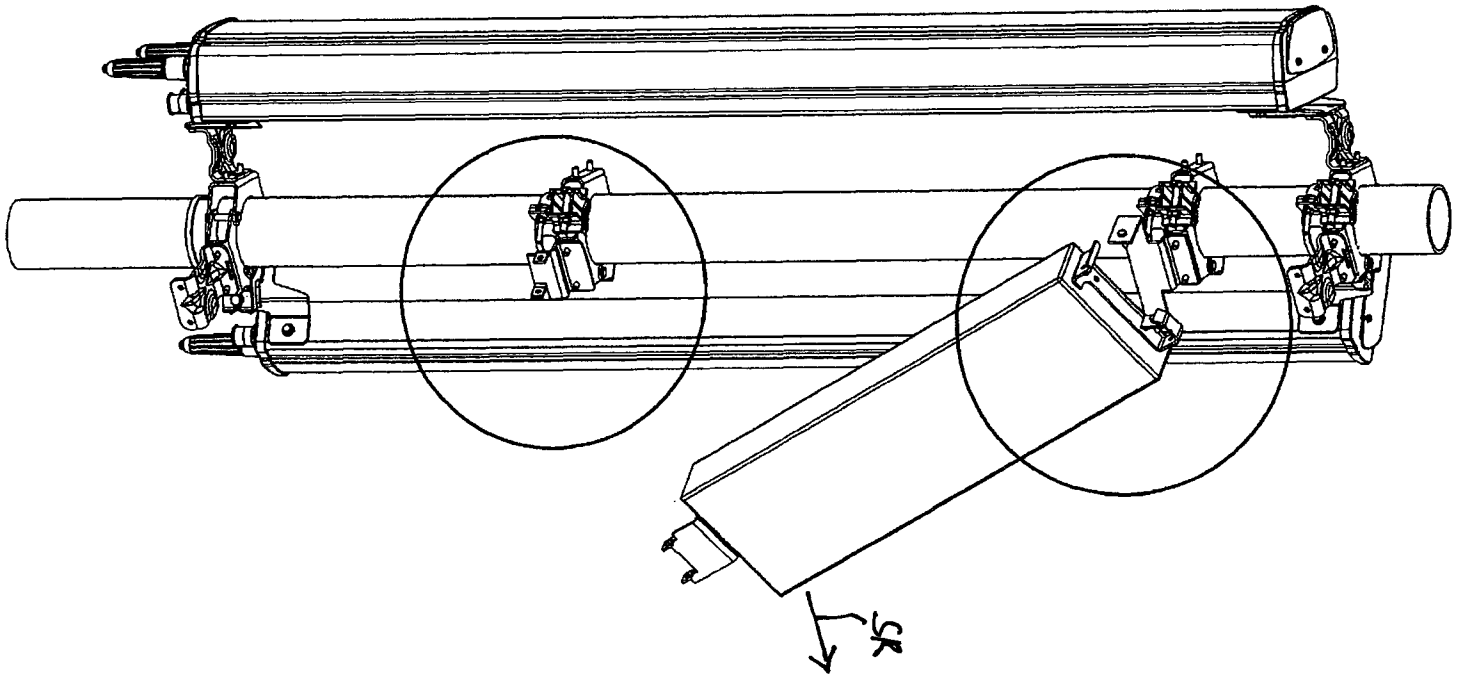
Figure 10B:
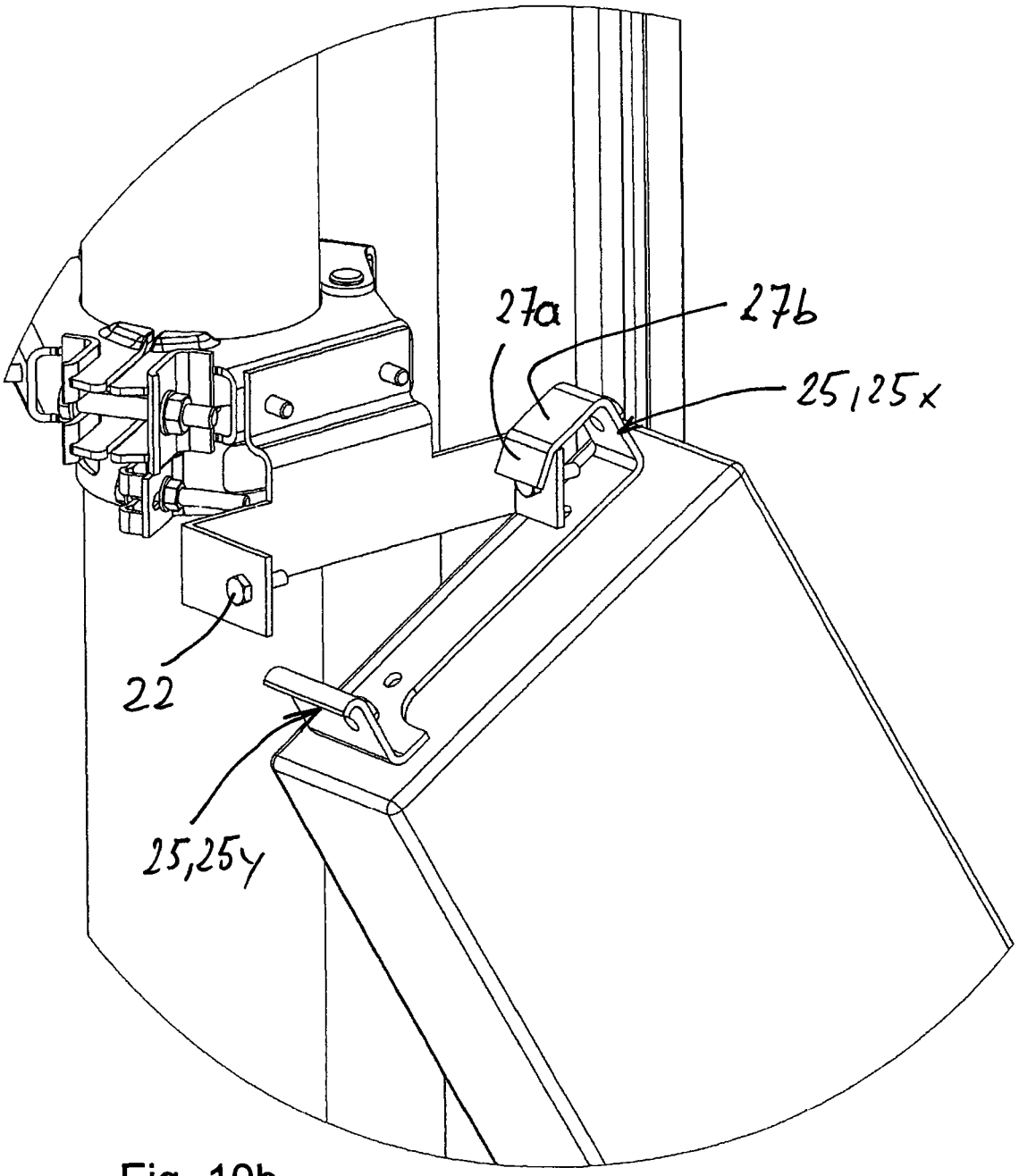
Figure 10C:
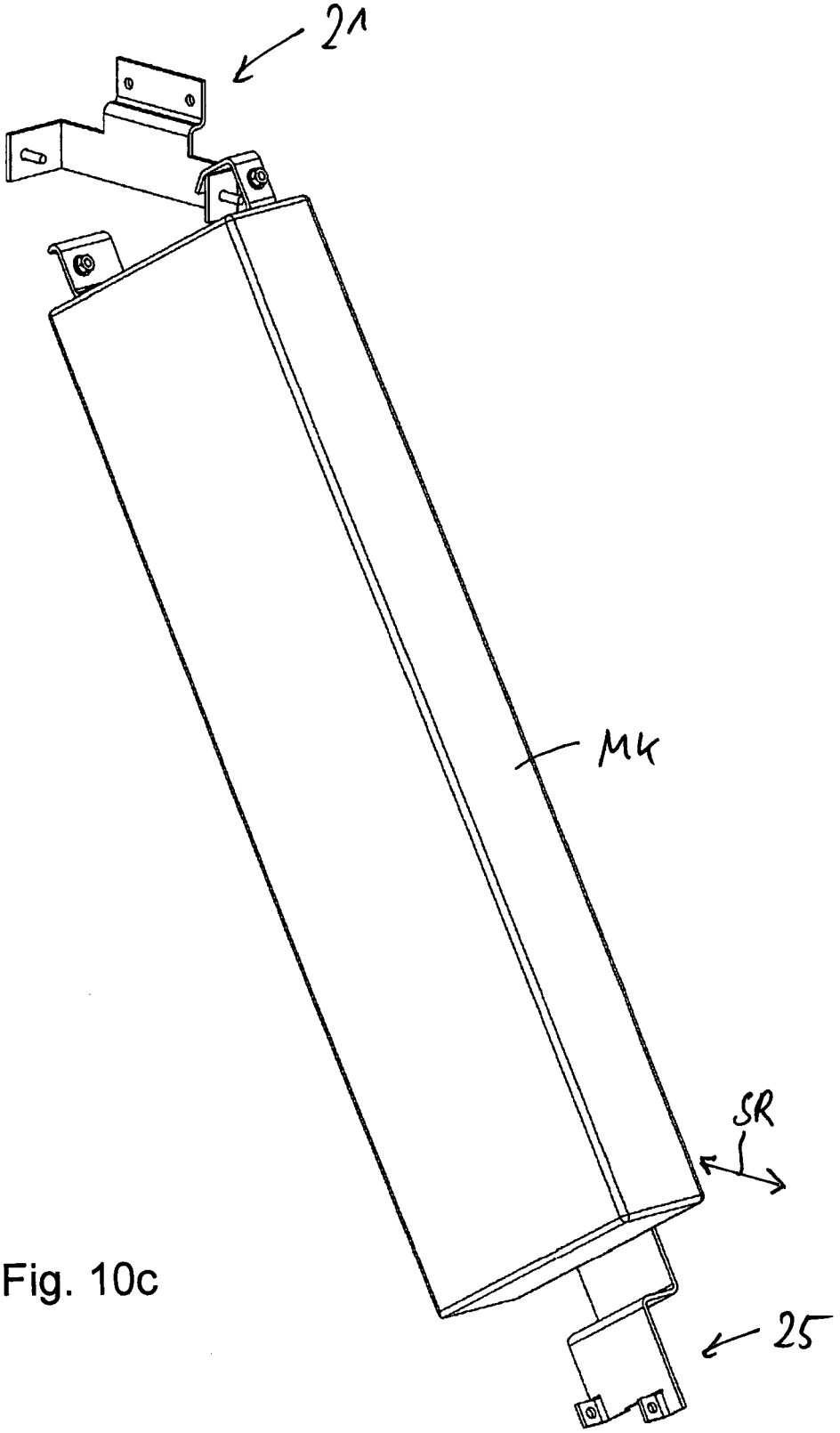
Figure 11A:
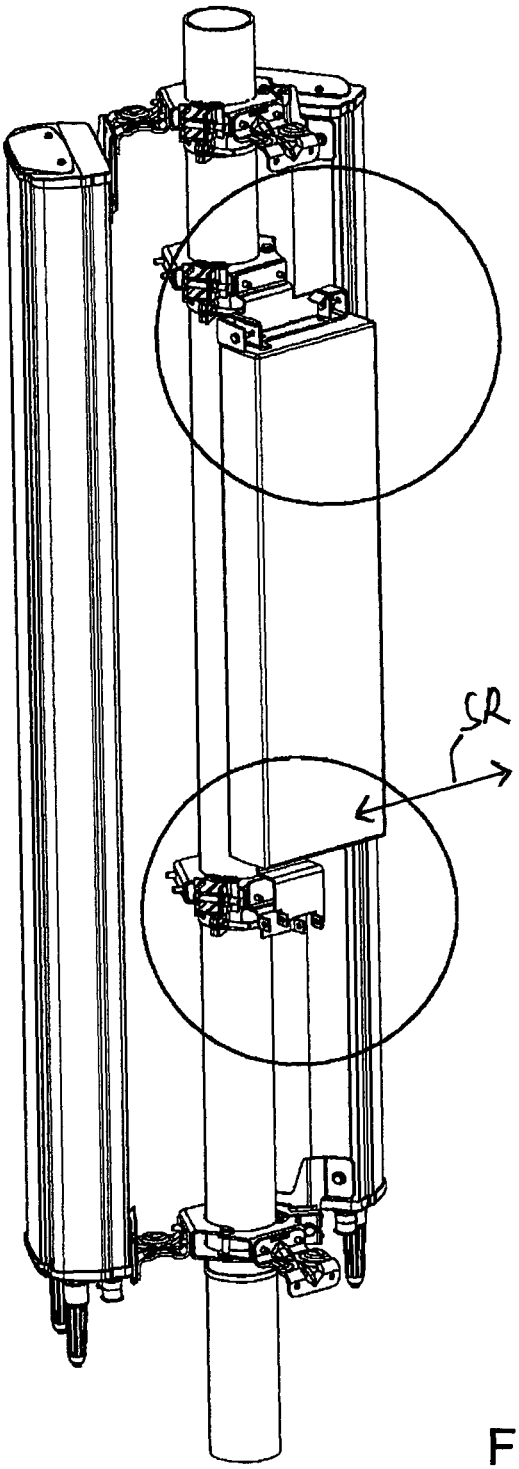
Figure 11B:
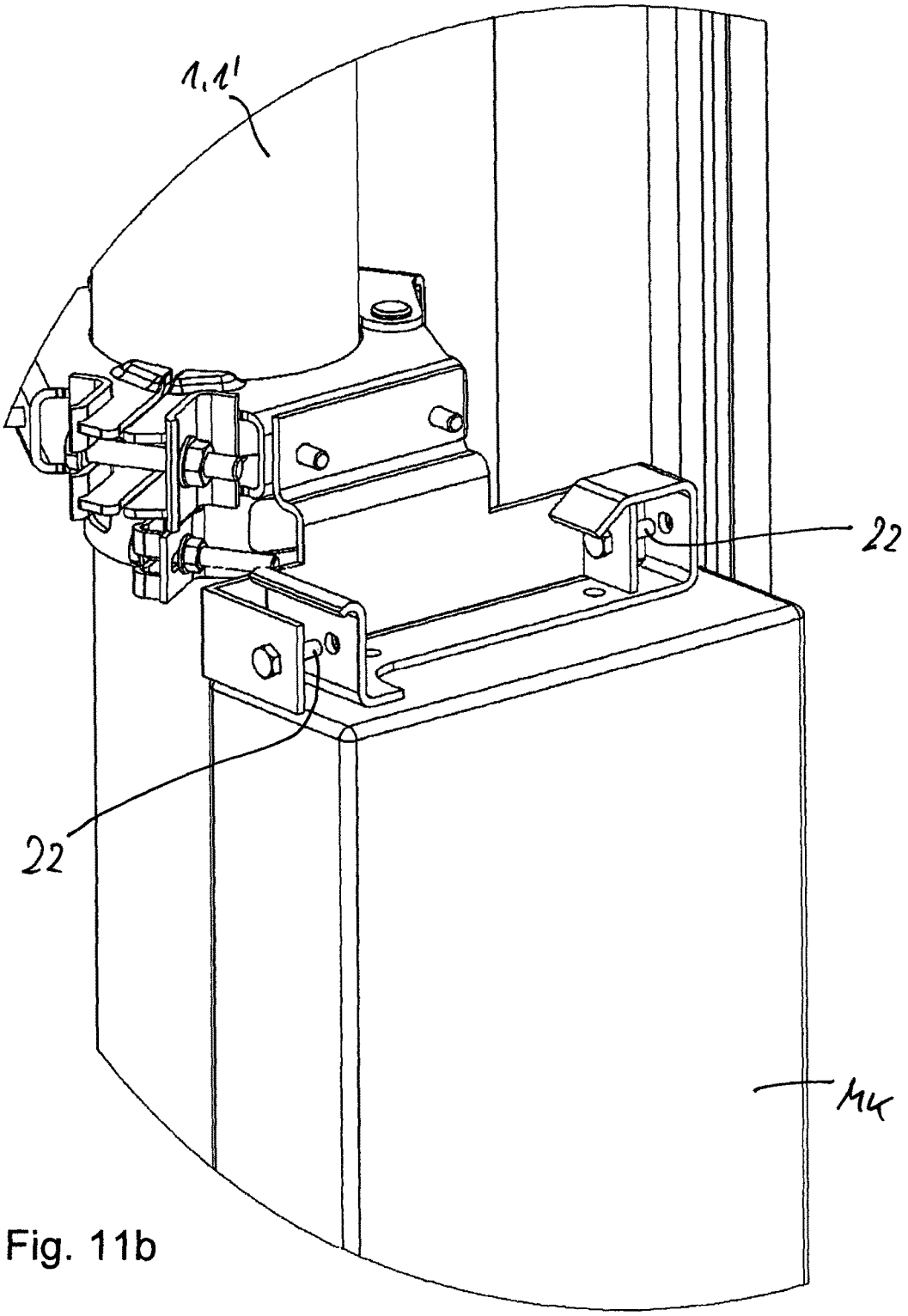
Figure 11C:
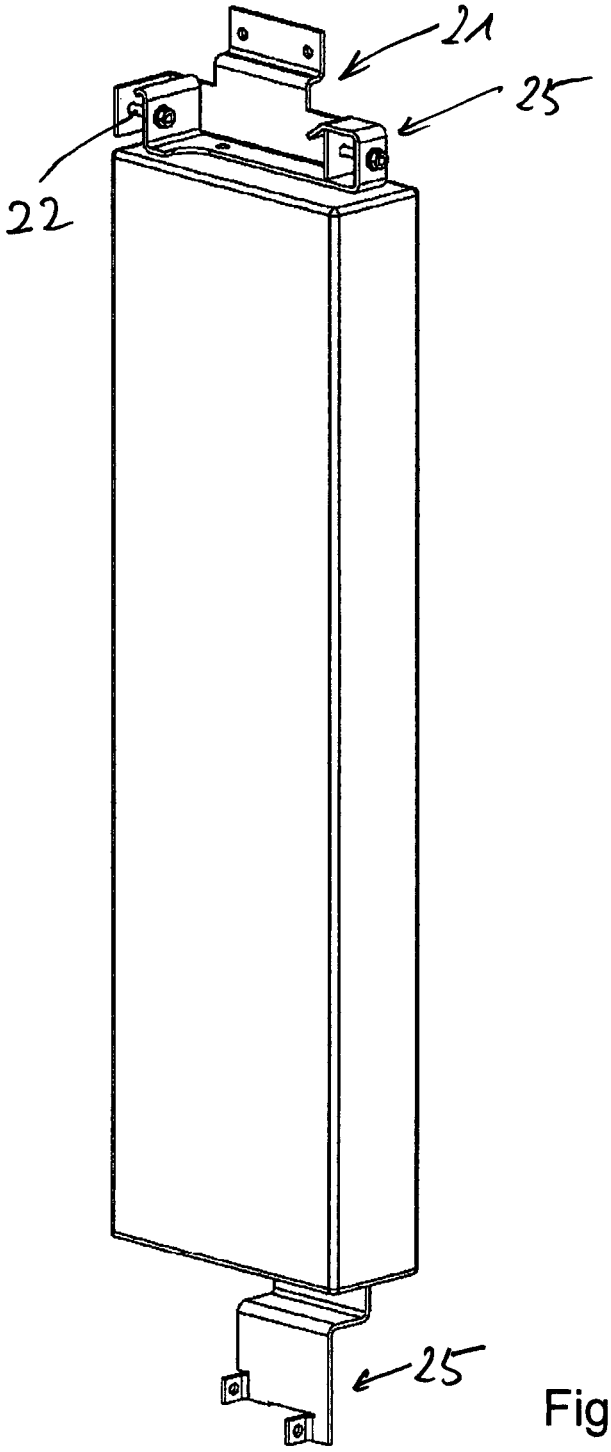

FIGS. 6*a* and 7*a* are two side views of a mobile-telephony antenna, comparable to FIG. 1*a* and 2*a*, during the installation or uninstallation of an individual mobile-telephony component;

FIGS. 6*b* and 7*b* are an axial plan view or view from below relating to FIGS. 6*a* and 7*a* during the mounting or dismounting of a mobile-telephony component;

FIGS. 8*a* to 8*c* are two three-dimensional drawings and a side view of the two cooperating connection supports, which are fixed to one another and form a releasable interface and/or partition with respect to one another;

FIGS. 8*d* and 8*e* are two drawings of a modified embodiment for two connection supports comprising an active integrated cooling system;

FIGS. 9*a* to 9*c* are various drawings of a modified embodiment in which a mobile-telephony component can initially be suspended and subsequently be pivoted and fixed;

FIGS. 10*a* to 10*c* are drawings corresponding to FIGS. 9*a* and 9*c* during a further intermediate phase during the suspension of a mobile-telephony component;

FIGS. 11*a* to 11*c* are corresponding drawings after the final suspension and translational displacement process of the mobile-telephony component, directly before or after the fixing screws are screwed in;

FIGS. 12*a* to 12*d* are various drawings of a modified embodiment with the mobile-telephony component completely released;

FIGS. 13*a* to 13*d* are drawings corresponding to FIGS. 12*a* to 12*d* but during an intermediate phase of the installation of a mobile-telephony component;

FIGS. 14*a* to 14*d* are drawings corresponding to FIGS. 13*a* to 13*d* but after the fixing position of the mobile-telephony component is definitively reached directly before or after the associated fixing screws are screwed in; and FIGS. 15*a* to 15*d* are various drawings of an embodiment in which a mobile-telephony component is installed on a wall as a support device, in front of which a mobile-telephony antenna disclosed by way of the other embodiments is likewise mounted on the wall, engaging around the mobile-telephony antenna or covering it from the front.

The following refers to a first embodiment.

In FIGS. 1*a* to 2*b*, a mast 1' is provided as the support 1 for the mobile-telephony antennas and the additionally provided mobile-telephony components.

On this mast-side support 1, a mobile-telephony antenna MA (for example a single-gap mobile-telephony antenna) is arranged at an orientation offset by 120° in the azimuth direction in each case, specifically comprising a radome 5 protecting the individual radiators. The mobile-telephony antennas 3 are mounted on the mast with the longitudinal extension thereof substantially vertical or generally in a predominantly vertical orientation.

As can already be seen from the plan view of FIG. 1*b* or the view from below of FIG. 2*b*, a support-side holding device, which in the embodiment shown consists of or comprises a support-side clip fixture 7', is used for fixing on the mast-shaped support 1.

In addition to this upper support-side holding device in the form of the support-side clip fixture 7', a clip fixture 7' positioned below is provided, via which the respective antenna MA is instead braced and held in the upper and lower longitudinal extension region with respect to the mast 1'.

Each of the mobile-telephony antennas MA preferably comprises a fixing portion 11' at the upper and lower ends thereof, preferably in the extension of the rear face thereof, which portion is also generally referred to as an antenna-side holding device 11.

In principle, an individual mobile-telephony antenna could be attached directly to the two carrier-side holding devices 7 positioned vertically offset on the mast and rigidly mounted, via the two mutually vertically offset antenna-side holding devices 11 thereof.

However, for visually appealing mounting, which in so far as possible is not visible from the outside, of the aforementioned mobile-telephony component MK, for example in the form of a remote radio head RRH, a holding arrangement is used in which a larger separating space A between the rear face of the respective mobile-telephony antenna and the support 1 is provided for the mobile-telephony antenna MA. For this purpose, the support-side holding device 7 and/or the antenna-side holding device 11 are formed with a large radial overhang, which forms a spacer which can be part of the corresponding holding device, or else a separate spacer 13 is provided, which can be rigidly attached to the support-side holding device 7 on the one hand and to the antenna-side holding device 11 on the other hand.

In the embodiment shown, the connection system at the upper end of the mobile-telephony antenna MA and at the lower end is identical in construction. In the case of a pre-settable mechanical downtilt angle, the radial length of the spacers could optionally be different, in other words the radial extent for example of the upper spacer could be greater than that of the lower one. It would also be possible to omit the lower (or upper) spacer, similarly to the generic prior art, if the upper (or lower) spacer is of a sufficient radial length.

In the embodiment shown, the mobile-telephony components are now preferably accommodated in the aforementioned separating space A, in the form of the remote radio heads. However, in this case the mobile-telephony components are preferably completely separated from the mobile-telephony antennas MA and the fixing device and means thereof, and fixed separately to the support 1; in other words, in the embodiment shown, fixed to the mast-shaped support. For this purpose, the support-side component holding devices 17 in the form of clip fixtures 17' (see FIGS. 4*a* to 4*d*) may optionally be formed identically to the clip fixtures 7'. The mobile-telephony components MK are likewise fixed via two component holding devices positioned offset in the axial direction on the support 1, as stated preferably using the identically constructed clip fixtures 7'. This also reduces the storage of the required parts. At these clip fixtures 17', the respective mobile-telephony components MK are subsequently likewise rigidly attached to and mounted on the support 1.

In the embodiment shown, the associated mobile-telephony components are fixed to the support-side component holding devices 17 in accordance with FIGS. 1*a* to 4*e*, for example via a component-side connection support 25, which is fixed to the mast at the two support-side component holding devices 17 in the form of clips. For each mobile-telephony component MK provided, a component-side connection support 25 is provided, which is held substantially parallel to the support 1, in the embodiment shown parallel to the mast 1', between two mutually axially offset clip-shaped fixing devices 17'.

As can be seen in particular from FIGS. 4*c* and 4*d*, this component-side connection support 25 is made plate-shaped or plate-like (although this is not absolutely compulsory), the plate-shaped support 21 being provided with two attachment flanges 21', protruding offset from the mobile-telephony component, in the embodiment shown. As a result, a second connection support 25, preferably releasably connected to the mobile-telephony component MK, cooperates, a holding portion having a channel-shaped or U-shaped or groove-shaped vertical section being formed along the upper edge region 25*a* and the lower edge region 25*b* of this component-side connection support 25 in the embodiment shown. The upper and lower holding portion 25*a*, 25*b*, in each case configured U-shaped or channel-shaped, is arranged in such a way that the corresponding openings in the channel-shaped or groove-shaped depressions of the two holding portions 25*a*, 25*b* face one another. In this case, the aforementioned connection support 21 is the second connection sub-unit 121.

As can also be seen in particular from FIGS. 8*a* to 8*e*, each first connection support 21 is connected via screws, in the region of the upper and lower flange regions 21' thereof, to the respective holding device 17, preferably in the form of the clip fixture 17', which can be attached to the mast, it being possible in principle to use screws for this purpose. Preferably, however, bolts are used for the fixing means, and are rigidly attached to the corresponding fixing parts in such way that after connection to a further part by the assembler only corresponding nuts still have to be screwed on for securing. As can further be seen from the drawings, a mobile-telephony component along with the connection support 25, which is assigned thereto are rigidly attached thereto, can be slid onto the connection plate 21 mounted on the support side, in that the upper and lower edge portions 25*a*, 25*b* of this second or antenna-side connection support 25, on which the mobile-telephony component MK is mounted, can now be slid laterally onto the upper and lower edge regions 21*a*, 21*b* of the first connection support 21, the U-shaped grooves 25'*a* and 25'*b* thus engaging around the corresponding edges 21*a* and 21*b* of the first connection support 21 (see FIG. 8*b*). The significance of this constructional principle is discussed further below.

Rigid fixing between the two connection supports 21, 25 may ultimately be provided by tightening the accordingly provided fixing means 27, threaded bolts preferably being used on the respective parts to be connected, specifically in particular in the form of press-fitted bolts which are pressed into corresponding, preferably hot-galvanised steel parts in the corresponding plate-shaped connection parts, in such a way that the assembler on site merely still has to screw corresponding nuts onto these threaded bolts to fix the parts.

As a result of the two mutually parallel first and respective second connection supports 21, 25, which are plate-like in the embodiment shown, an interface and/or partition X, discussed further in the following, is formed between the first and second connection units 121 and 125 which are thus formed.

A single-sector antenna (comprising one or more gaps) or a mobile-telephony antenna device comprising two or for example three, etc., sector antennas can be mounted in accordance with the embodiments shown in the following manner.

Initially, for example the one or more preferably pre-mounted mobile-telephony components MK are raised up on the mast 1' and parallel thereto using a suitable pulling and lifting device, specifically while the clip fixtures 17' are still open. In other words, the carrier-side component holding devices 17 are open. For this purpose, the clips are constructed in such a way that aside from a clip base 31' (see for example FIG. 1*b* or 4*c*), in other words a holding device base 31, they comprise two holding device arms 33, which can be pivoted outwards or inwards in an articulated manner and which can each be pivoted outwards or inwards about a vertical pivot axis 35 extending parallel to the mast-shaped support 1. For mounting on the mast 1', these pivot arms are pivoted outwards, specifically far enough that these pivot arms engage around the mast 1' and can be closed after the engagement. Subsequently, one or more transverse screws 37 for rigidly fixing the support-side holding device 7 thus formed to the mast-shaped support 1 are tightened. Usually, the width of the individual mobile-telephony components MK is such that the aforementioned pivot arms 33 along with the mobile-telephony components carrying them can be opened and pivoted far enough outwards that the clips thus formed can be placed laterally on a mast and engage around it while closing.

Once the mobile-telephony components MK are pre-mounted in this manner, in a following work step the further, likewise already pre-mounted mobile-telephony antennas MA can be raised up using a corresponding crane or pulling device, the respective three mobile-telephony antennas formed in the manner of sector antennas being interconnected via the respective upper and lower antenna-side holding device 11, the spacer 13 and the support-side holding device 7 in the embodiment shown. Equally, however, the individual mobile-telephony antennas and even the mobile-telephony components could also be mounted in succession.

In this case too, the support-side holding devices, which consist of the same clip-shaped holding devices which are also used for fixing the mobile-telephony components to the support 1, can be placed at the correspondingly correct height and rigidly mounted on the support 1 by opening the pivotable arms thereof (on the mast).

Since as stated both the mobile-telephony components and the mobile-telephony antennas are mounted on the support 1 completely separately from one another, the mounting can also be carried out completely independently. Likewise, as seen radially, the mobile-telephony components MK are shielded and protected from the front (radially with respect to the mast-shaped support) by the individual mobile-telephony antennas MA, including visually, the supporting forces of the mobile-telephony antennas and the mobile-telephony components and the wind forces acting thereon in each case merely being braced via the holding devices which separately support them.

If an individual mobile-telephony component fails and/or needs to be replaced for any reason, this is possible without difficulty, since the aforementioned mobile-telephony components MK are ultimately connected to the support 1 via a first and second connection unit 121, 125 so as to form an interface and/or partition therebetween. In other words, in this case the preferably clip-shaped support-side component holding devices 17 on the mast 1 do not have to be released.

Likewise, it is not necessary to release any fixing means, such as screws, which may be provided on the rear face of the individual mobile-telephony components in order to uninstall a mobile-telephony component from the mast. This solution prevents fixing means, which are only very poorly accessible from the rearward face, from having to be released or tightened.

In the embodiment shown, merely the fixing means, preferably in the form of screws, bolts and/or nuts, via which the first and second connection unit 121, 125 are interconnected, have to be released. As a result of the selected orientation of the threaded bolts, the free ends thereof are easily accessible from the side, and so in this case corresponding nuts can be tightened for fixing or loosened for releasing without difficulty.

After these screws, in other words preferably the bolts, held pressed into the fixing parts, and nuts, are loosened, the mobile-telephony component, which is thus already released and now no longer fixed, is nevertheless still equally held in position, since the plate-shaped second connection unit 125, rigidly connected to the associated mobile-telephony component MK, is still held by the rimmed edge portions 25*a* and 25*b* on the first support-side connection support 21, in other words on the first connection unit 121. This offers the possibility that only after all screw and connection means are released, the mobile-telephony component which is thus already released and correspondingly prepared can subsequently be slid out of the fixing device laterally, in other words preferably parallel to the interface plane, in other words parallel to the mast 1' and thus parallel to the plane of the two mutually parallel connection units 121, 125, in other words in the lateral direction SR as additionally shown in two different side views in FIGS. 6*a* and 7*a* on the one hand and in an axial plan view in FIG. 6*b* on the other hand in an axial view from below in FIG. 7*b*. It can be seen from the drawings that the respective mobile-telephony component (MK) from the separating space (A) can be guided out of or into the separating space (A) by the narrow housing side thereof, more or less parallel to the externally adjacent mobile-telephony antenna, which is preferably likewise orientated with the wide face thereof parallel to the wide face of the housing, although this need not necessarily be the case. The lateral outward movement from the separating space A or conversely the inward movement of the mobile-telephony component into the separating space A thus takes place substantially with a horizontal component which extends through the separating space with a lateral offset from the support 1, in particular from the mast 1'. In other words, the dismounting or mounting movement or change in position of the relevant mobile-telephony component MK is preferably carried out by the narrow side thereof, in other words parallel to the housing narrow side thereof or in the pivoting and/or displacement plane E as shown in FIG. 2*a*.

Once a corresponding mobile-telephony component has been removed, the next one can be raised by a crane or lifting device and the upper and lower edges 25*a*, 25*b* thereof can be slid laterally into the receiving grooves 21*a*, 21*b* of the first connection unit 121 with the second connection unit thereof. As a result, the mobile-telephony component is initially pre-adjusted and made available. In the following step, the fixing screws can subsequently be screwed in and tightened so as to fix the mobile-telephony component securely, in that the support-side connection support 21 and the antenna-side connection support 25 are rigidly interconnected, in particular screwed together.

In principle, the two aforementioned connection supports 21 and 25 (in other words the two connection units 121 and 125) may also be provided in an interchanged manner, in such a way that the plate-shaped connection support 21 is for example fixed and thus rigidly connected to the rear face of a mobile-telephony component MK whilst the second connection support 25 provided with the rimmed edges is subsequently fixed to the support 1 via the aforementioned support-side component holding devices 17, for example by means of the clip-shaped holding devices on a mast-shaped support 1'.

FIGS. 8*a* to 8*c* show the construction of the two connection supports 21, 25, in other words the two connection units 121, 125, in greater detail. It can thus be seen that each of the two connection units is provided with straps laterally strapped around through 90°, in such a way that the two parts can each be displaced into the other laterally, in other words parallel to the planar extension thereof. An inwardly projecting mandrel, in other words a mandrel projecting in the insertion or assembly direction, is formed on one side flange 21*c* (see also FIG. 4*b* and FIG. 8*a*), and automatically engages in the hole 25*f* provided in the counter flange 25*e* of the other connection unit when said counter flange is approached, and centres the two parts with respect to one another.

Further, at this first connection support 21, opposite the aforementioned side flange 21*a*, two smaller side flanges 21*c* and 21*d* are provided, at each of which bolts 21*g* and 21*h* are pressed in projecting in the same connection or insertion direction, in other words in the same direction as the mandrel 21'*e*, and thereby held on the first connection parts 1, just as bolts pressed into the steel parts are used as connection means on all of the parts used, which are preferably made of hot-galvanised steel, an assembler on site subsequently merely still having to screw nuts onto said bolts for fixing or screw them in the opening direction to release the parts. Thus, when the two connection supports 21, 25 are being joined together, not only does the aforementioned mandrel 21'*e* engage in the central opening 25*f* of the side flange 25*e* of the second connection support, but the aforementioned two threaded bolts 21*g* and 21*h* engage in the corresponding holes 25'*c* and 25'*d* of the respectively opposite straps 25*c* and 25*d*, thus protruding through these openings (which are preferably configured as slightly elongate holes to compensate tolerance errors), in such a way that the assembler subsequently merely still has to screw onto the overhanging parts of the bolts to fix the aforementioned nuts. It can thus also be seen that the fixing elements have to be screwed in and unscrewed transversely and thus substantially horizontally with respect to the mast, thus always being easily accessible from the side.

Reference is also further made to the accompanying FIGS. 8*d* and 8*e*, which show a modification of the connection units 121, 125 shown in FIGS. 8*a* to 8*c*.

The basic construction of these connection units 121, 125 is left unchanged from the previous embodiments. The change relates to an active cooling system, in such a way that an electrically drivable ventilator 24, which in the embodiments shown has an axis of rotation 24*a* perpendicular to the central plate portion 26*a*, is installed in one connection support 25 (in other words in one connection unit 125), for example in the central support- or plate portion 26*a*. For this purpose, the central plate portion 26*a* further comprises at least one opening or clearance 26*b* in the manner of a window.

At the central plate portion 22*a*, positioned parallel at a distance therefrom, of the other connection support 21 (in other words the connection unit 121), in the embodiment shown a number of openings or clearances 22*b* are formed in the manner of a number of windows. This provides the possibility of thereby installing an active cooling system in the separating space B between the two central plate portions 22*a*, 26*a* of the two connection supports 21, 25, for example so as to cool the mobile-telephony component, which in some cases consumes high levels of power during operation and thus contributes to considerable heating. As a result of the active cooling system, this can be countered by simple means. During the operation of the ventilator 24, cooling air can be blown towards the mobile-telephony component through the window 22*b*, 26*b*.

The further drawings, FIG. 9*a* onwards, show two further modified principles, to the extent that for example a suspension mechanism is used for pre-adjustment of a mobile-telephony component to be newly installed or for intermediate bracing of a mobile-telephony component to be removed.

In this case too, in each case a connection support 21 is used which is fixed to the support 1 using the support-side component retainers 17. However, in this embodiment the connection support 21 is not formed plate-shaped and thus does not connect the upper support side component retainer and the lower one axially offset therefrom, but rather a support-side connection support 21 is provided for each support-side component retainer 17, and can be separately mounted on or rigidly and permanently connected to the clip-shaped support-side component holding device 17 if this connection support 21 is to be part of the clip-shaped component holding device 17.

In this embodiment of FIG. 9 onwards, the connection support 21 is fork-shaped in a plan view and comprises two support arms 21*c* which protrude away from the rearward support 1 in a finger shape or prong shape (FIGS. 9*a* and 9*b*).

In this embodiment, the corresponding second connection support 25, in other words the component-side connection support 25, is preferably provided on the mobile-telephony component MK on the upper face 41 thereof, and has two differently sized elbows 25*x* and 25*y*, which are formed in the manner of suspension elements.

In particular the suspension element 25*e* on the right in FIG. 9*b* has a larger elbow having a front suspension portion 27*a*, tapering onto the upper face 41 of the mobile-telephony component MK and having a following hook portion 27*b*, which extends parallel to the upper face 41 and comes to be positioned on the mobile-telephony component at a distance from the upper face for the fixing portion 27*c* of the hook arrangement. During the mounting of a corresponding mobile-telephony component, as indicated in FIGS. 9*a* to 11*b*, this provides the possibility of initially suspending the mobile-telephony component, after raising it using a suitable lifting tool, on the one of the two support arms 21*c* of the support-side connection support 21 by way of the suspension element 27. Pressed-in bolts are in turn rigidly anchored to the two support arms 21*c*, and project freely in the same direction. Subsequently, the mobile-telephony component can be gripped in particular in the lower region and initially pivoted clockwise, in the embodiment shown in the corresponding drawing, in the lateral direction SR until the aforementioned horizontally projecting bolts 22 come to be positioned at the level of the corresponding holes in the angles 25*x* and 25*y*. Subsequently, the mobile-telephony component, in the vertical orientation thereof in which the aforementioned holes come to be positioned horizontally in the angles 25*x* and 25*y*, can be displaced further laterally, in other words in the lateral direction SR, on the first connection support 21, until the corresponding bolts 22 engage in the holes of the second connection support 25. In this situation, the upper elbow 25'*y* thus also comes to be positioned above the upper edge of the second elbow 25"*y* of the support-side connection support 21. Thus, the mobile-telephony component has already taken on the final mounting position thereof. In this position, the corresponding fixing screws merely still have to be fixed so as to hold the mobile-telephony component. A connection support 25 positioned below (attached to the underside of the mobile-telephony component) likewise pivots into the final mounting position thereof, in which it comes into contact with a corresponding first connection support 21, so as to screw in screws, extending between the two preferably on corresponding flanges transversely to the mast, and secure the mobile-telephony component.

The corresponding mounting and moving sequence is shown in FIGS. 9*a* to 11*a*, FIGS. 9*b* to 11*b* each showing an enlarged detail of the suspension- and fixing mechanism on the upper face of the mobile-telephony component.

It can thus be seen that the fixing means, preferably in the form of threaded bolts and nuts to be screwed onto them for rigidly fixing the two connection units 121, 125, in other words for rigidly connecting the two connection supports 21, 25, extend transversely to the longitudinal direction of the mobile-telephony components MK, thus in particular preferably horizontally, meaning that they are accessible in a particularly user-friendly manner in each case to the side of the mobile-telephony component, so as to screw them in or if required unscrew them, so as thus to fix the mobile component rigidly or release it.

The dismounting takes place in a reversed manner. The corresponding fixing means between the two connection supports 21, 25, in other words between the support-side connection support 21 and the antenna-side connection support 25, have to be released, so as subsequently to slide the mobile-telephony component out of the anchoring somewhat, specifically in the direction in which the suspension element 27*a* equipped with the longer suspension finger is formed. Subsequently, the mobile-telephony component can pivot outwards in the lateral direction SR into the pivot position shown in FIGS. 10*a* and 10*b*, specifically likewise again preferably with respect to the pivoting and/or displacement plane E defined by the rear face of the mobile-telephony antenna AM located in front (FIG. 2*a*). In this shown position, the mobile-telephony component can subsequently be raised by a pulling device and, after a slight lateral offset is carried out, be let down alongside the connection support 21.

This embodiment also shows that in each case in the connection region between the mobile-telephony component and the antenna-side support 1, an interface and/or partition X is formed, which is formed between the support-side connection support 21 and the antenna-side connection support 25. Thus, in this formation too, all of the mobile-telephony components can be raised during the initial mounting in the pre-mounted position with open clip supports, and subsequently be fixed to the mast after the enclosure by the clip supports, so as to mount all of the mobile-telephony components jointly. Subsequently, the antennas are mounted, as described above for the previous embodiments. If one mobile-telephony component is subsequently to be replaced with another, this can take place without the mobile-telephony antennas being dismounted, in that, as described, the corresponding mobile-telephony antenna is displaced and/or pivoted in part in the planes thereof extending parallel to the mast and thus also parallel to the rear face of the mobile-telephony antennas positioned in front.

By way of the further embodiments of FIG. 12*a* onwards, it is also further shown that, using similar connection technology (in other words without the connection support described by way of the first embodiment), a mobile-telephony component which is accordingly to be dismounted or mounted can be placed slightly overlapping on corresponding connection parts 21 and subsequently brought into the desired end position merely by translational displacement in the lateral direction SR, or can be displaced outwards in translation during the dismounting so as subsequently to be raised and completely extracted laterally and set down on the ground.

Figure 12A:
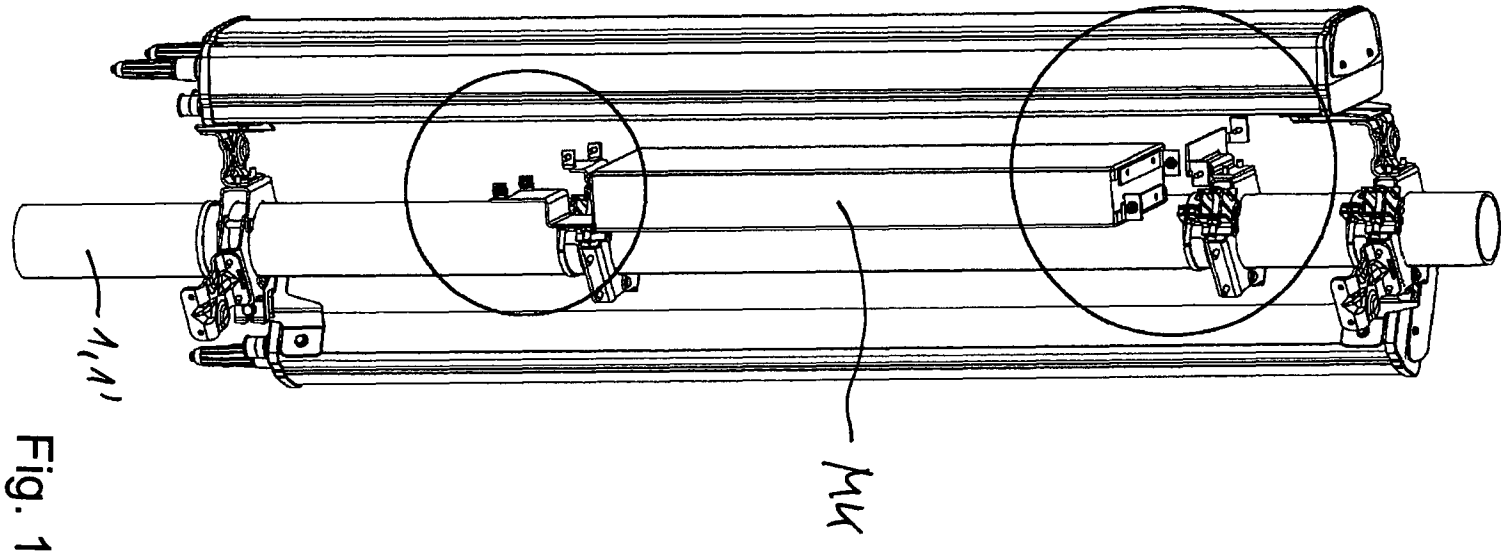
Figure 12B:
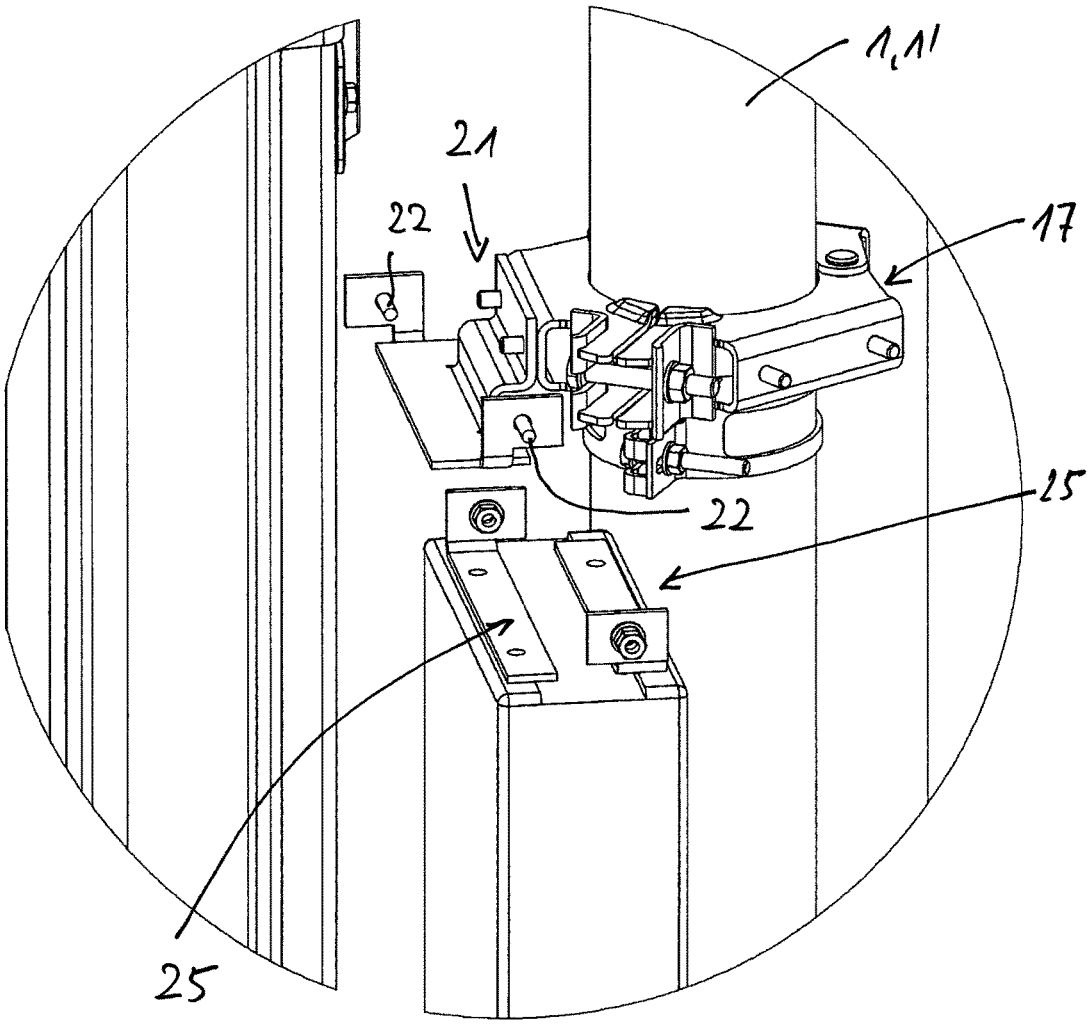
Figure 12C:
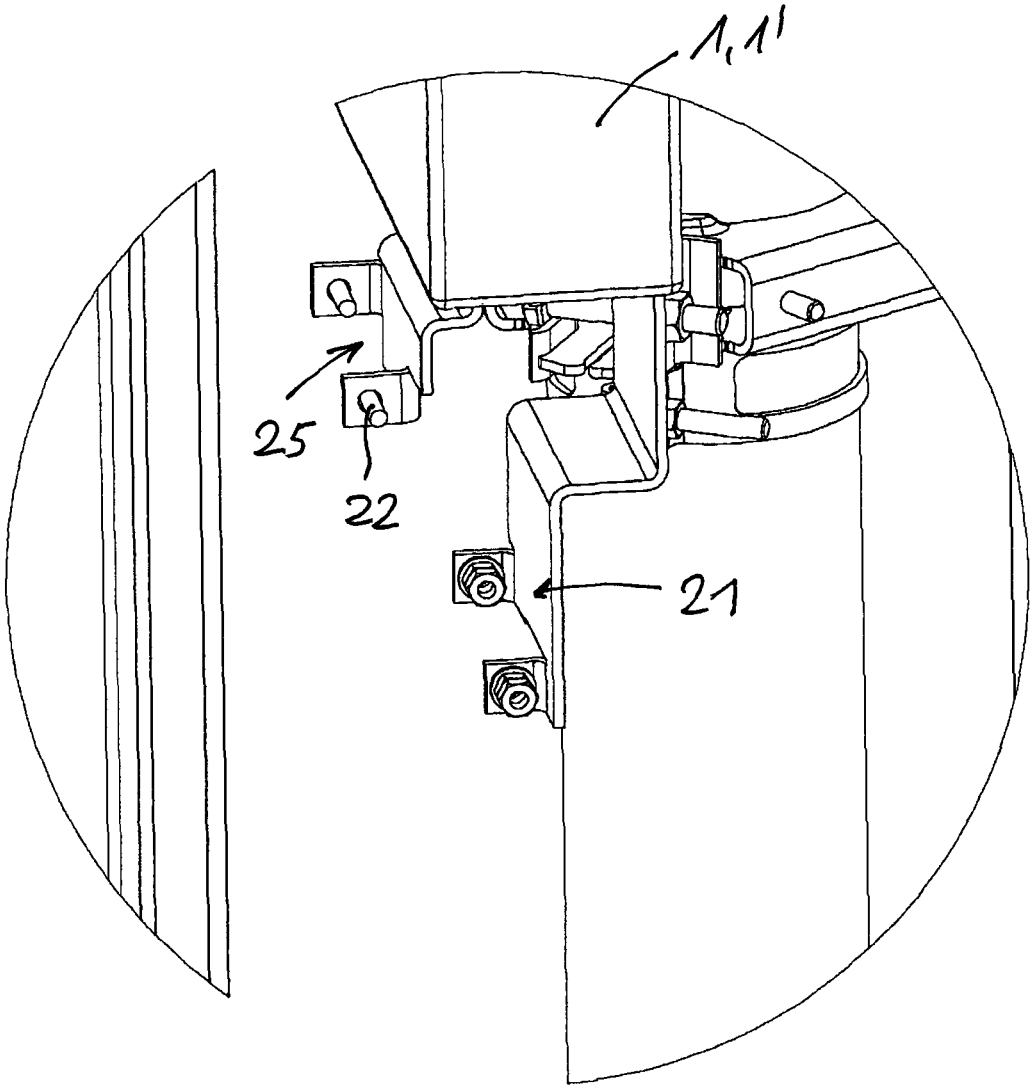
Figure 12D:
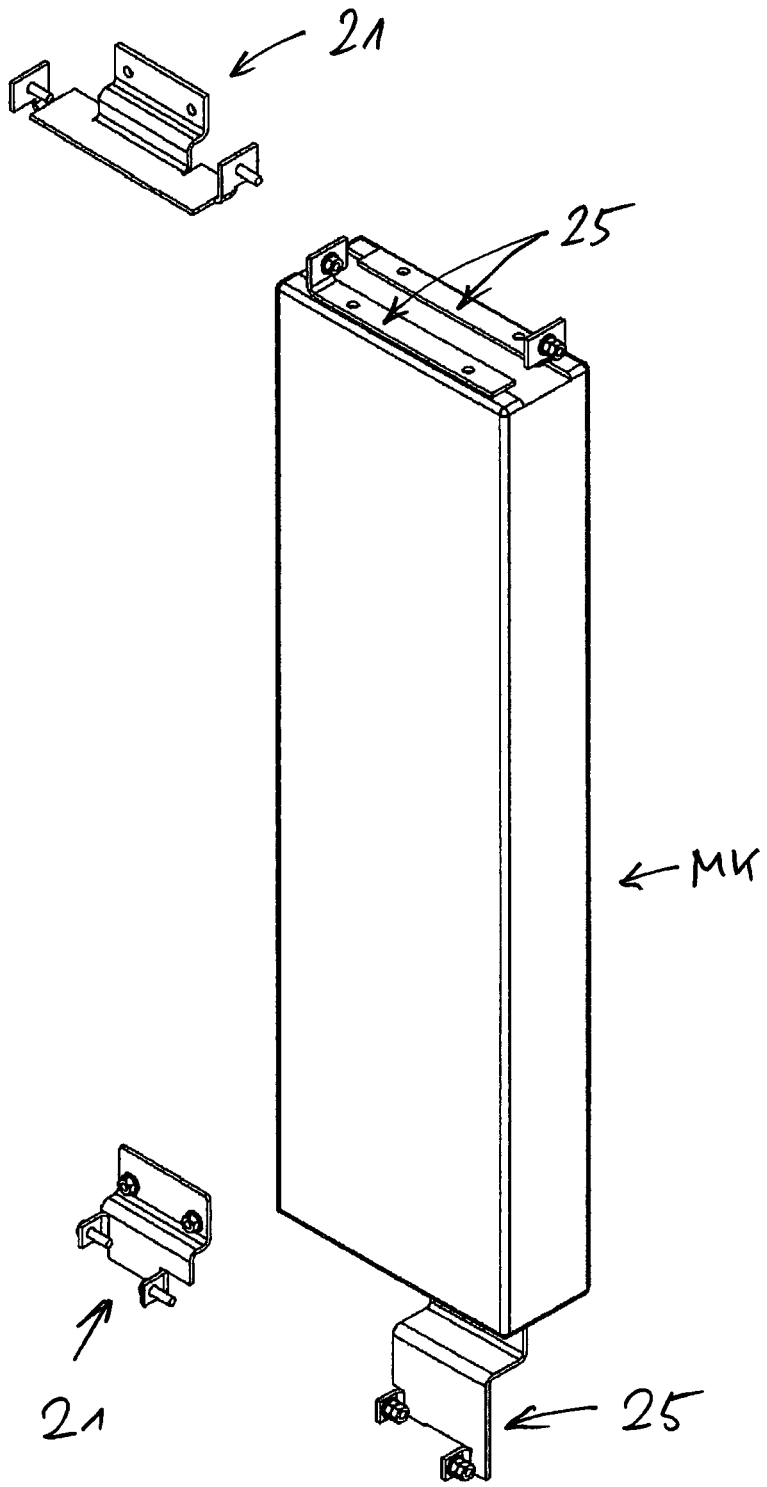
Figure 13A:
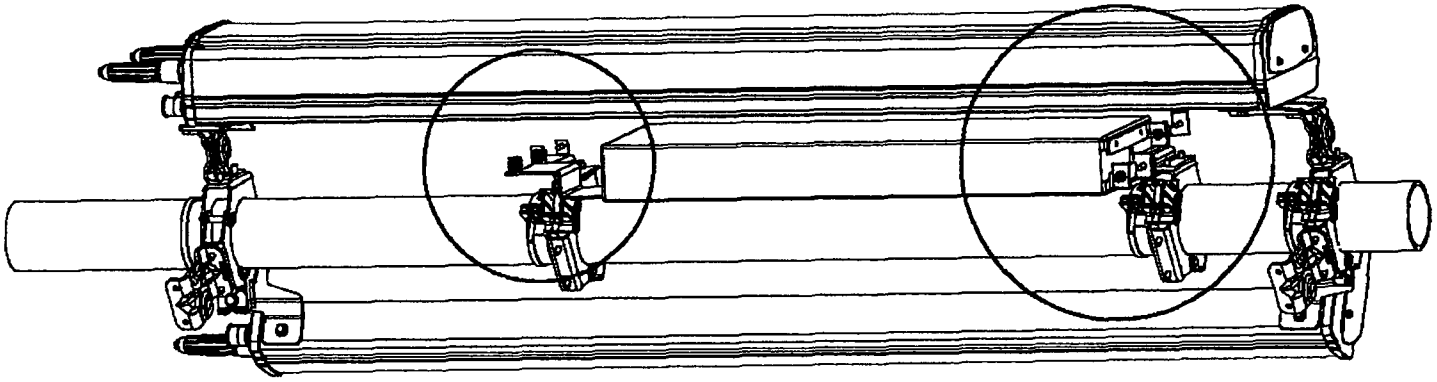
Figure 13B:
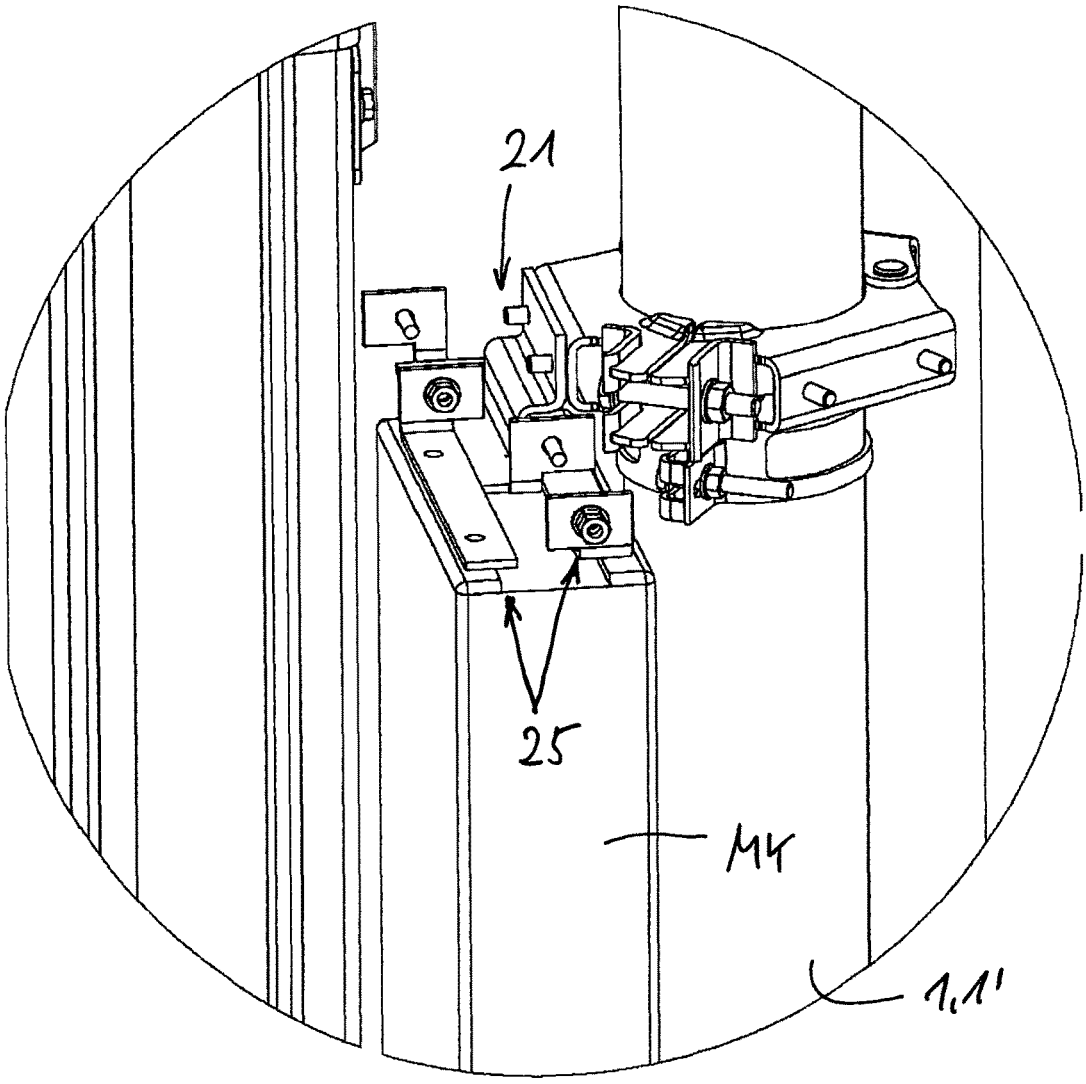
Figure 13C:
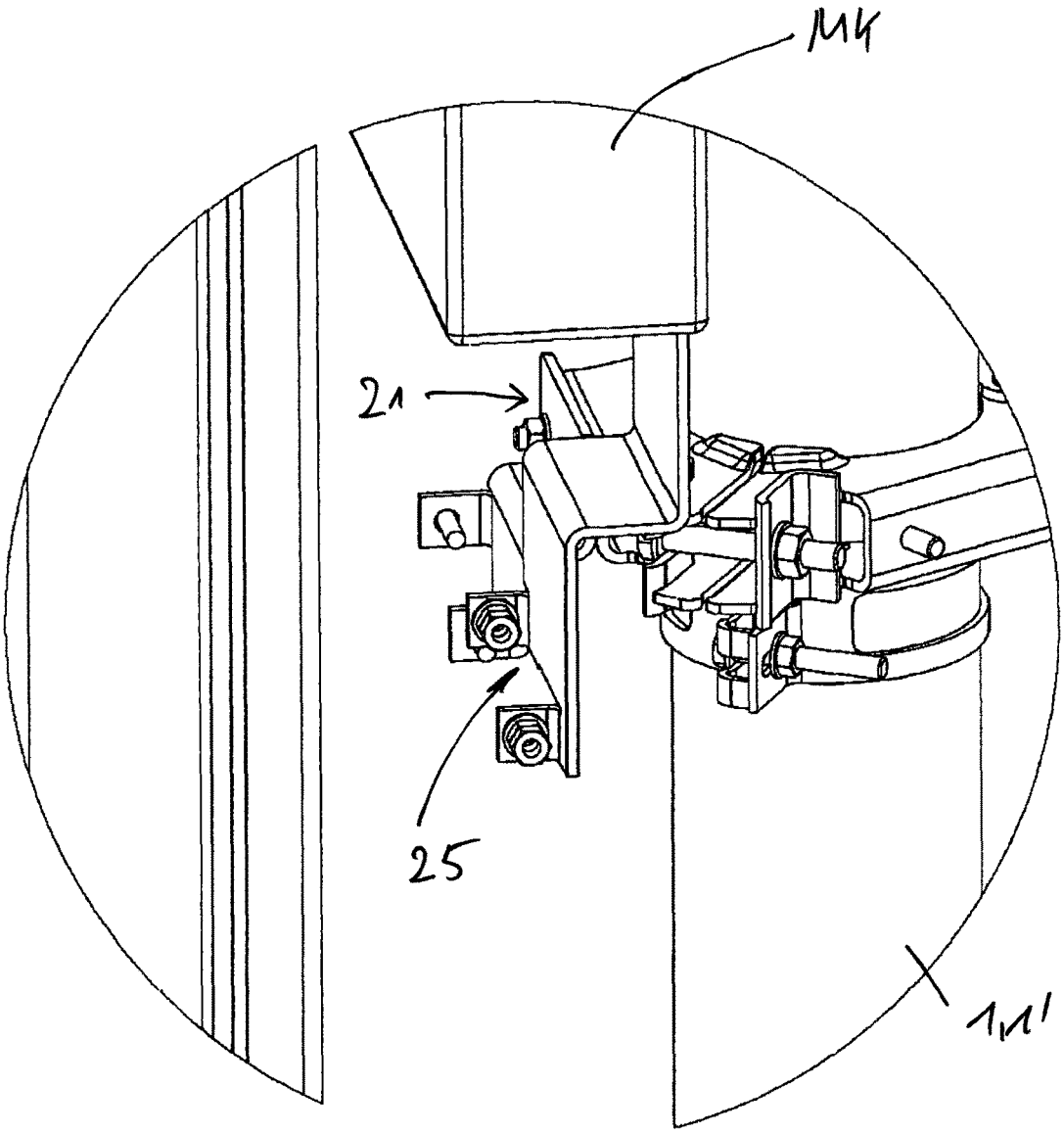
Figure 13D:
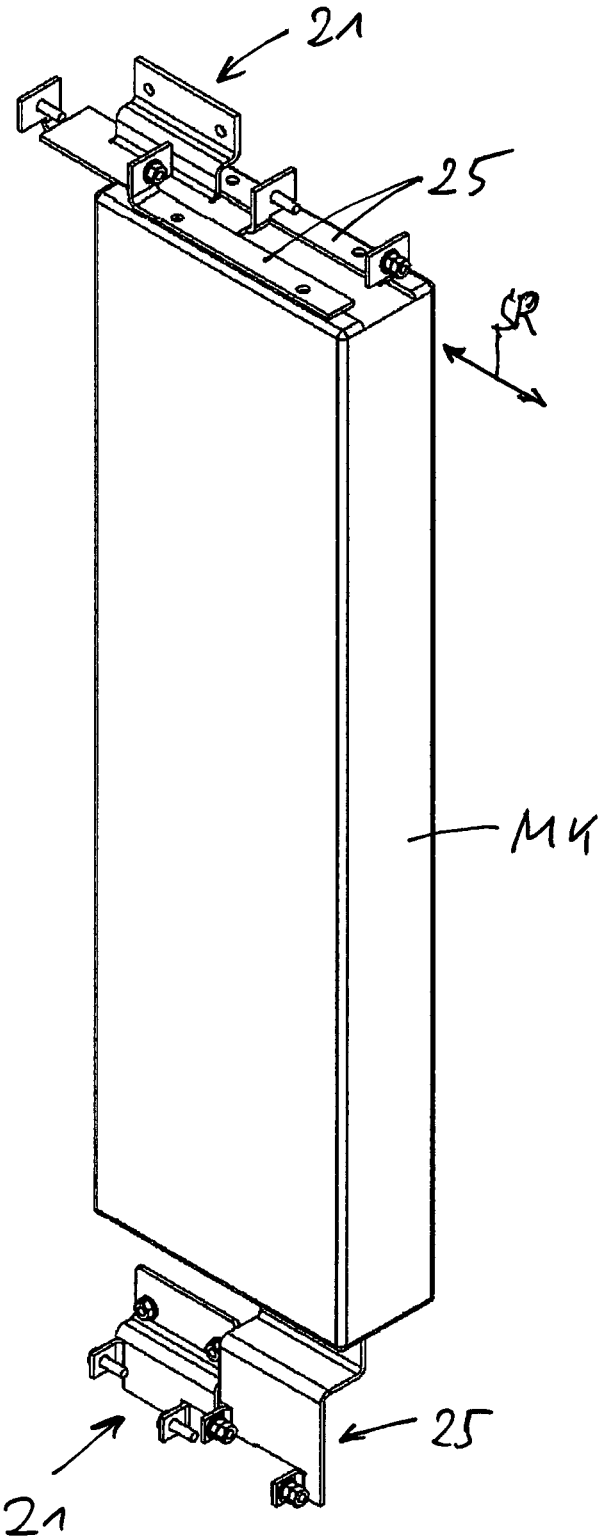
Figure 14A:
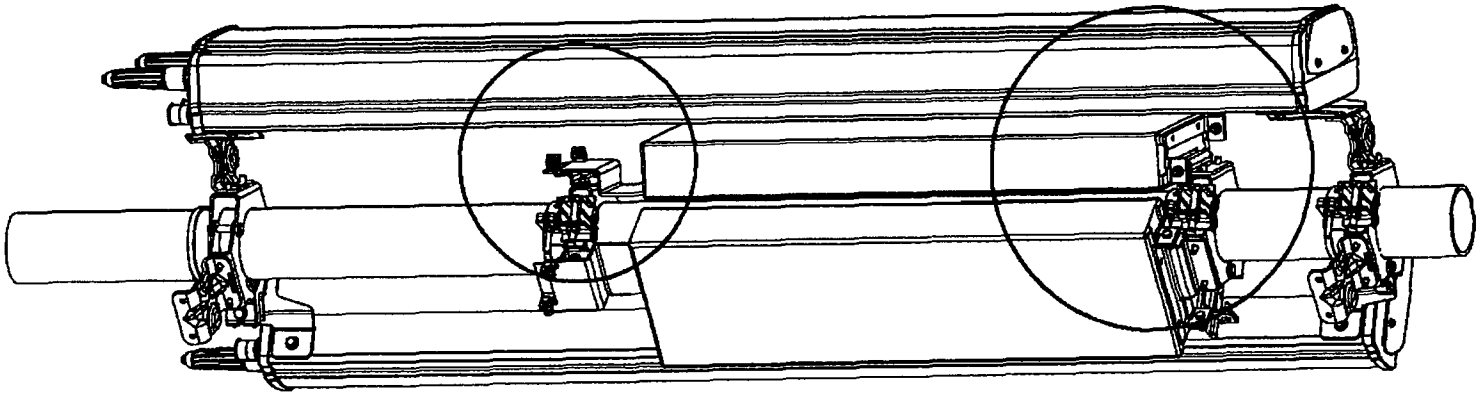
Figure 14B:
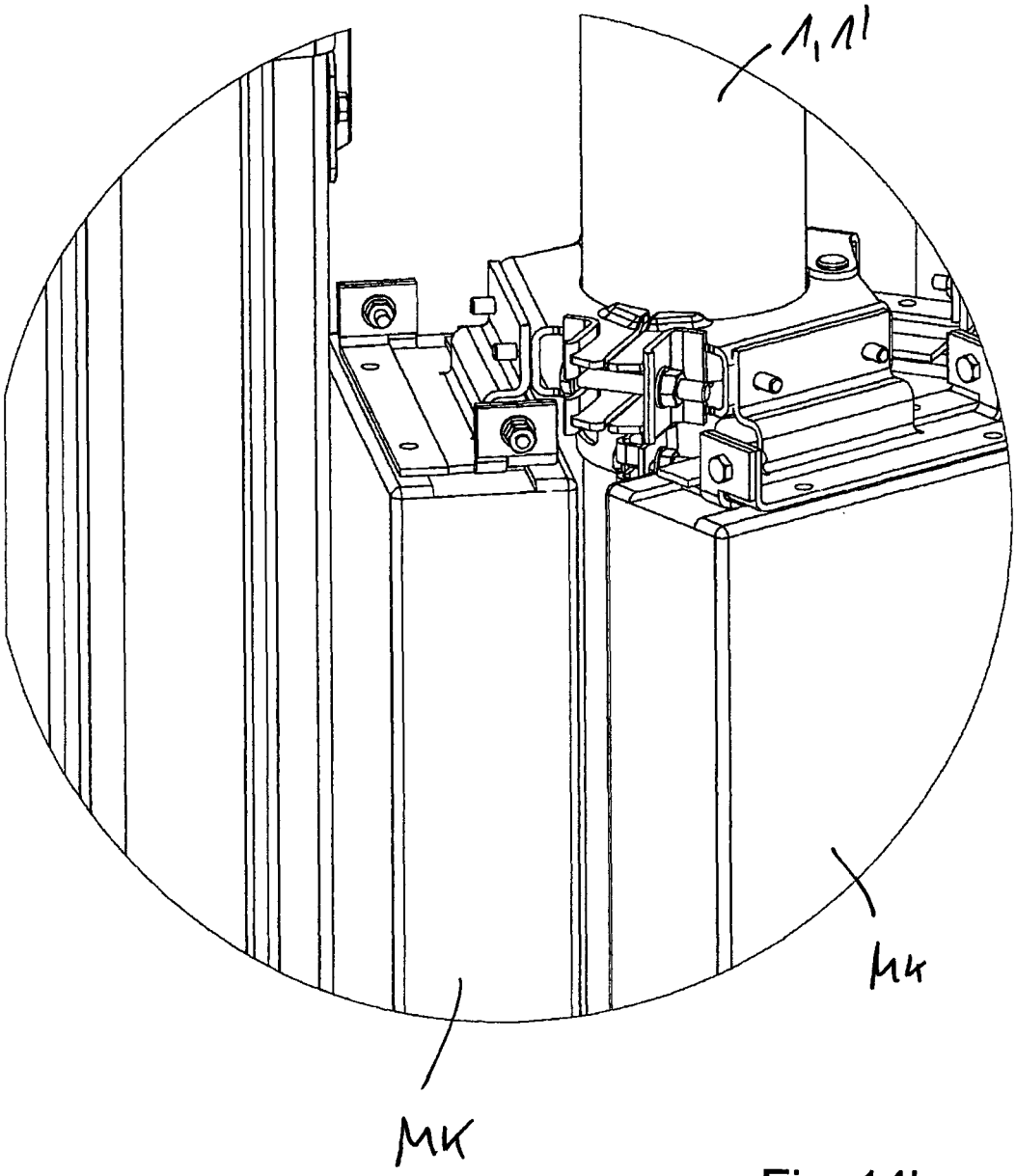
Figure 14C:
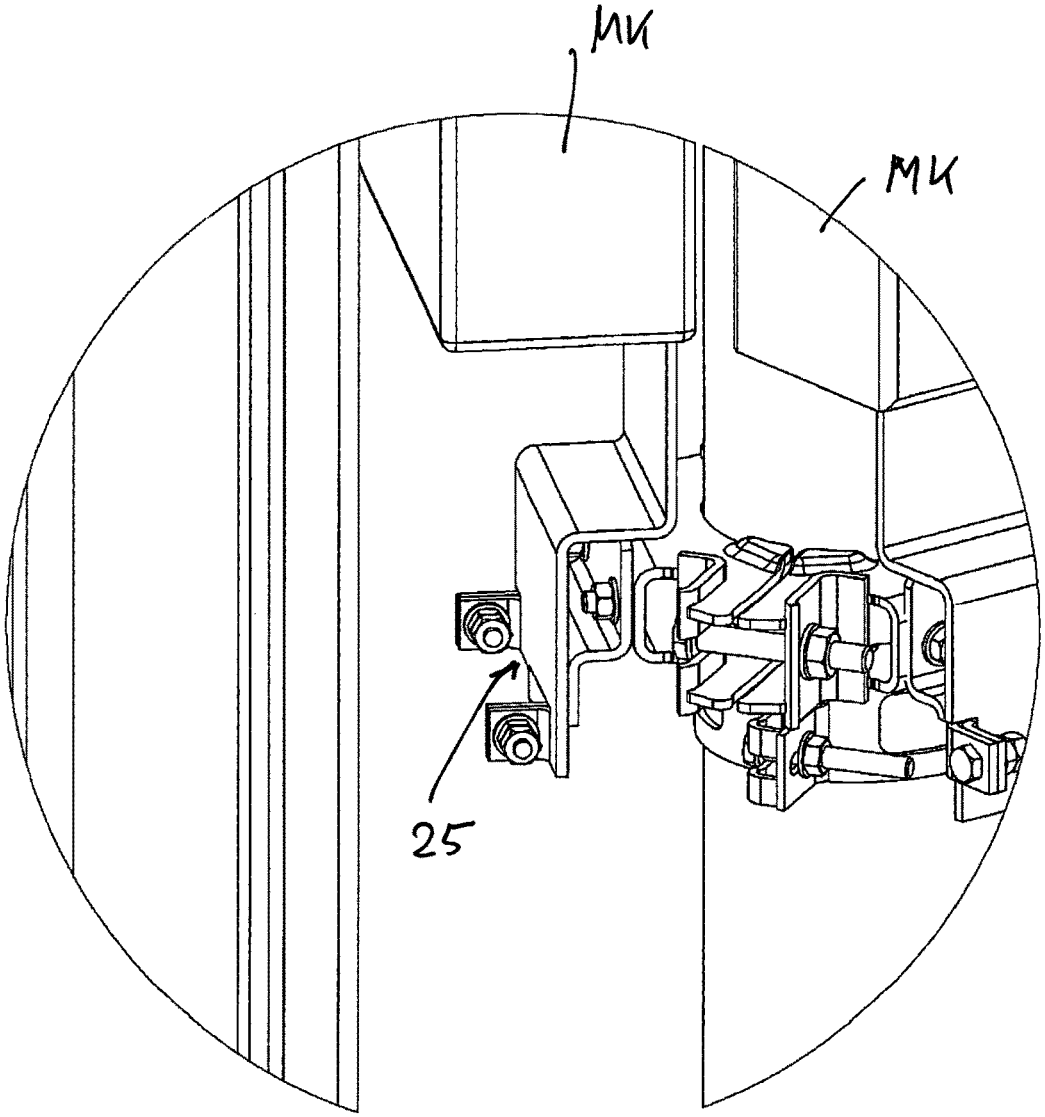
Figure 14D:
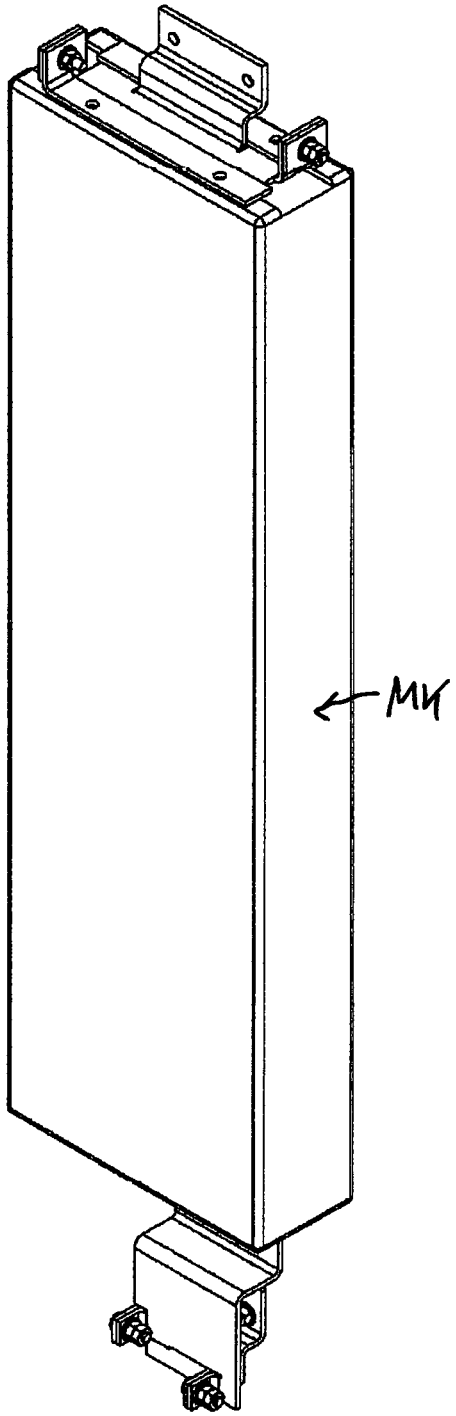
Figures 15A, 15B, 15C, 15D:
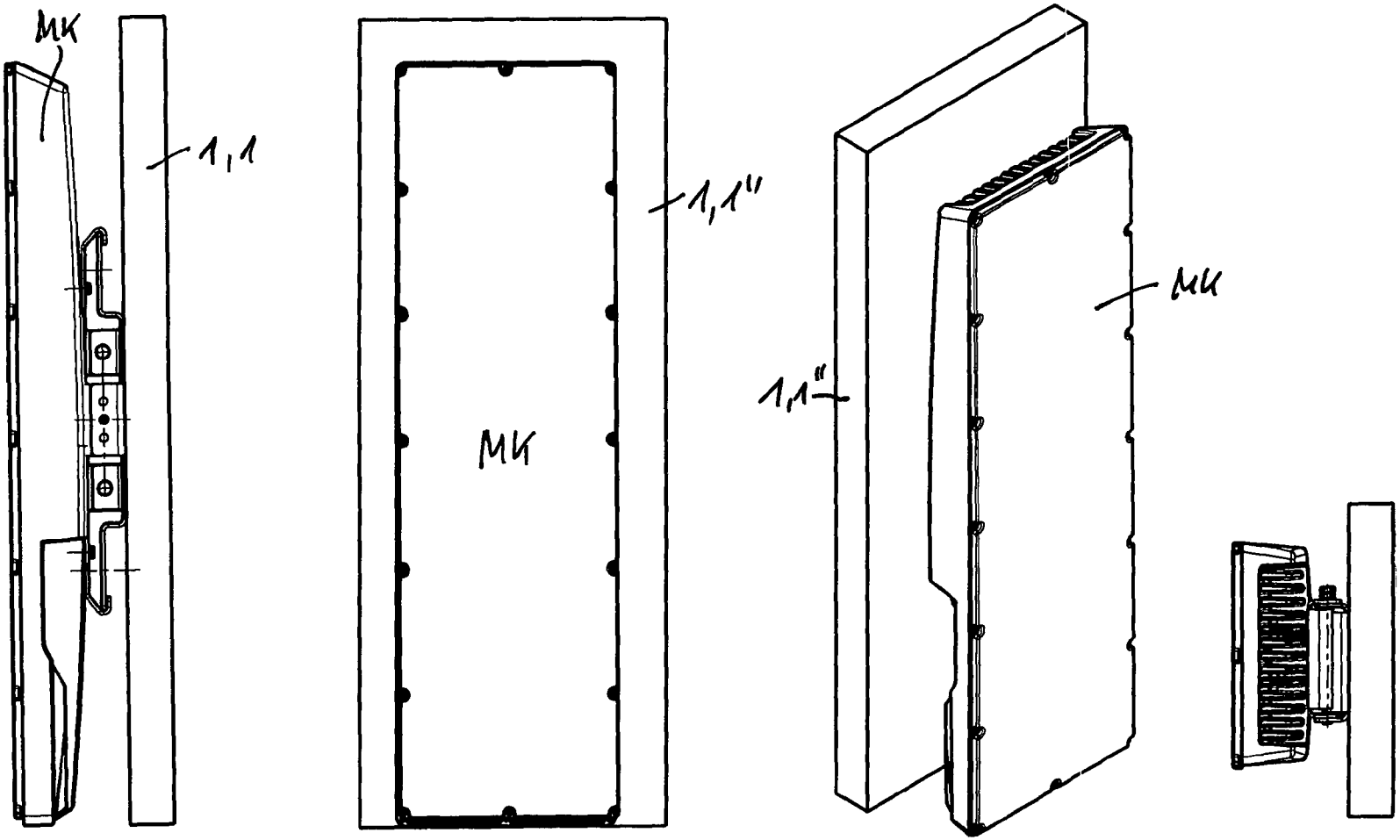

FIGS. 12*a* to 12*c* show the initial situation during the initial mounting of a mobile-telephony component (for example when a mounted mobile-telephony component has previously been dismounted from the mast). FIGS. 13*a* to 13*d* show the intermediate phase in which the component-side support device 25 of the mobile-telephony component is slid laterally onto the support-side support device 21, the support device 21 in each case being connected, positioned axially offset on the mast, to the respective support-side component holding devices 17, in other words the clips 17', whilst FIGS. 14*a* to 14*d* show the final mounting position.

In this case too, the component-side connection device 25 positioned underneath on the respective mobile-telephony component also meshes with a corresponding support-side connection device 21, corresponding, preferably pin-shaped axial projections engaging in lateral flanges in accordance with the clearances, in such a way that the mobile-telephony component is braced and held at the two narrow longitudinal faces thereof, as can also be seen clearly from the drawings.

The following drawings, FIGS. 15*a* to 15*d*, merely further show that for example a single-gap or multi-gap mobile-telephony antenna MA can also be fixed to a building-side support 1, in other words to a building 1". In this case, support-side holding devices 11 or support-side component holding devices 17 are used both for the mobile-telephony antenna MA and for the mobile-telephony component MK, and are held and anchored for example by way of holes and dowels to be introduced into the building. However, the further construction and holding mechanism to be added thereto is comparable with the described embodiments relating to mounting on a mast 1'.

The various embodiments have been described for the case where two support-side or mast-side component holding devices 17 and thus also two support-side connection supports 21 are used in each case, on which for example the two component-side connection supports 25 engage. If plate-shaped connection supports are used, the support-side connection support 21 may be fixed to the two preferably support-side, in other words clip-shaped, component holding devices 17.

As a result, a high supported load, which also receives high wind forces, can be braced securely on the mast or wall via which the entire antenna arrangement comprising the mobile-telephony components is held. However, in particular if comparatively small and light mobile-telephony components MK are to be used, it may be sufficient for merely a support-side component holding device 17 and/or merely a component-side holding device 25 to be provided for retaining and fixing the mobile-telephony component, in other words also merely a connection support 25 or merely a connection unit 125, via which the mobile-telephony component is held. However, the fixing mechanisms may otherwise be comparable with the described embodiments, it being possible for example for the connection supports 21 and 25 shown by way of the embodiment of FIGS. 8*a* to 8*c* to be fixed in the central region thereof to a corresponding holding and support device on the mast or on a wall, and for the component-side connection support cooperating therewith likewise to be connected centrally to the mobile-telephony component.

The invention claimed is:

1. Retainer system for a mobile-telephony antenna and a mobile-telephony radio, the mobile-telephony antenna and the mobile-telephony radio each being mountable on a mast-shaped or wall-shaped support, the retainer system comprising:

at least two antenna holding devices, structured to be mounted on the support side and positioned vertically or predominantly vertically mutually offset, having an upper and a lower antenna holding device, each of the at least two antenna-side antenna holding devices being fixable or fixed directly or indirectly to a support-side antenna holding device, at least one spacer, which is part of at least a support-side antenna holding device or an antenna-side antenna holding device or is mounted as a separate component between the at least one and two support-side and antenna-side antenna holding devices, between the upper and the lower antenna holding device on the one hand and between the support-side holding device and the mobile-telephony antenna on the other hand, a separating space open in a lateral direction is provided, in which a mobile-telephony radio is mountable or mounted, the mobile-telephony radio being fixed on the support side by a retainer arrangement, which is separated from the holding devices for the mobile-telephony antenna, the retainer arrangement comprising at least one support-side mobile-telephony radio holding device, the mobile-telephony radio comprising at least one component-side mobile-telephony component holding device, the radio being structured to communicate with the antenna to process signals received by the antenna and/or provide the antenna with signals to be transmitted, between the support-side mobile-telephony component holding device and the respective component-side mobile-telephony component holding device, a pivoting and/or displacement plane is formed, the support-side mobile-telephony component holding device and the respectively associated component-side mobile-telephony component holding device being releasably fixed to one another via a fixing device at the pivoting and/or displacement plane whereby the mobile-telephony radio can be mounted, demounted or replaced on a rear side of the mobile antenna without changing the position of the mobile antenna, and the component-side mobile telephony component holding device being structured such that when the associated fixing device is released, the mounted mobile-telephony radio is removable from the separating space in the lateral direction, by way of the component-side mobile-telephony component holding device, by translating and/or pivoting and/or rotation, leaving behind the support-side mobile-telephony component holding device, even while the mobile-telephony antenna is still mounted.

2. Retainer system according to claim 1, wherein the mobile-telephony component holding device mountable on the support corresponds to the support-side antenna holding device.

3. Retainer system according to claim 1, further comprising:

two support-side mobile-telephony component holding devices arranged at an axial distance from one another, a connection support in the form of a first connection sub-unit between the two support-side mobile-telephony component holding devices, the component-side mobile-telephony component holding device which is connected to the mobile-telephony radio being provided with a second connection support in the form of a second connection sub-unit, the first and second connection sub-unit being fixed or fixable to one another by screws.

4. Retainer system according to claim 3, wherein the pivoting and/or displacement plane are formed between the two connection supports or the two connection sub-units and extend through the separating space in the lateral direction, and the two connection supports, in the form of the connection sub-units are fixable to and released from one another at this interface and/or partition or the pivoting and/or displacement plane.

5. Retainer system according to claim 1, wherein a separate connection support is installed both on the first and on the second support-side component holding device, the mobile-telephony radio being mountable or mounted, by way of the component-side second connection support or connection units thereof, on the two mutually spaced connection supports.

6. Retainer system according to claim 5, wherein the at least two component-side connection supports are premounted on an upper end face and/or on a rear wall of a mobile-telephony radio.

7. Retainer system according to claim 1, wherein the support-side or the component-side connection support is formed in such a way that during the mounting of the mobile-telephony radio it is, in an intermediate step, suspendable by a suspension mechanism in the region of the upper end thereof on a support-side connection support, and subsequently bringable into the final mounting position thereof by pivoting and/or translational displacement, and conversely removed.

8. Retainer system according to claim 1, wherein both the component holding devices and the support-side antenna holding devices are mountable on the support, which is in the form of a mast-shaped support or a wall-shaped support.

9. Retainer system according to claim 1, wherein an active cooling system is integrated into the region of the pivoting and/or displacement plane, in the region of the two connection supports which are releasably fixed to one another or of the two connection sub-units.

10. Retainer system according to claim 9, wherein an electrically driveable ventilator is accommodated in a separating space between two plate portions of the two connection supports, and at least one or more openings or clearances are provided transversely to the two connection supports, so as to blow the air used for cooling through them by the ventilator.

11. Retainer system according to claim 1, further comprising a support-side component holding device, which is mounted or mountable on the support, and a connection support in the form of a first connection sub-unit, to which the component side holding device is fixed or fixable as a second connection support in the form of a second connection sub-unit by screws, on the support-side component holding device, the provided mobile-telephony radio being held and fixed on the second connection support or the second connection sub-unit.

12. Retainer system according to claim 1, wherein the housing narrow side of the mobile-telephony radio is translatable and/or pivotable out of the separating space in the lateral direction.

13. Retainer system comprising:

an upper antenna holding device structured to be fixable to an upper support-side antenna holding device;

a lower antenna holding device structured to be fixable to a lower support-side antenna holding device and an associated antenna, the upper and lower antenna holding devices being vertically mutually offset from one another to define a separating space open in a lateral direction;

a mobile radio retainer disposed in the separating space, the mobile radio retainer being distinct from the upper and lower antenna holding devices, the mobile radio retainer comprising at least one support-side mobile-radio holding device and at least one component side mobile radio holding device;

a mobile-radio structured to be fixed on a support side by the mobile radio retainer component-side mobile-radio holding device, the radio being structured to communicate with an associated antenna to process signals received by an antenna and/or provide the antenna with signals to be transmitted;

the mobile-radio, the support-side mobile-radio holding device and the component-side mobile-radio holding device defining a pivoting and/or displacement plane therebetween;

a fixing device disposed at the pivoting and/or displacement plane, the fixing device releasably fixing the support-side mobile-radio holding device to the component-side mobile-radio holding device;

the component-side mobile radio holding device being structured such that when the fixing device is released, a mounted mobile-radio is freed and movable away from the separating space in the lateral direction, by way of the component-side mobile-radio holding device, leaving behind the support-side mobile-radio holding device, while the antenna remains mounted whereby the mobile radio can be mounted, demounted or replaced on a rear side of the antenna without requiring a change in position of the antenna.

14. The retainer system of claim 13 wherein the component-side mobile radio holding device is structured such that when the fixing device is released, a mounted mobile-radio pivots away from the separating space in the lateral direction, by way of the component-side mobile-radio holding device.

* * * * *